US007210982B2

(12) United States Patent
Watanabe et al.

(10) Patent No.: US 7,210,982 B2
(45) Date of Patent: May 1, 2007

(54) METHOD AND APPARATUS FOR POLISHING A SUBSTRATE

(75) Inventors: Itsuro Watanabe, Kanagawa (JP); Takashi Kubo, Kanagawa (JP)

(73) Assignee: Asahi Glass Company, Limited, Tokyo (JP)

( * ) Notice: Subject to any disclaimer, the term of this patent is extended or adjusted under 35 U.S.C. 154(b) by 0 days.

(21) Appl. No.: 11/512,208

(22) Filed: Aug. 30, 2006

(65) Prior Publication Data

US 2007/0000874 A1 Jan. 4, 2007

Related U.S. Application Data

(60) Division of application No. 11/045,089, filed on Jan. 31, 2005, now Pat. No. 7,115,022, which is a continuation of application No. PCT/JP03/09745, filed on Jul. 31, 2003.

(30) Foreign Application Priority Data

Jul. 31, 2002 (JP) ..... 2002-223001

(51) Int. Cl.
*B24B 49/00* (2006.01)

(52) U.S. Cl. ..... 451/41; 451/57; 451/278

(58) Field of Classification Search ..... 451/41, 451/57, 260, 267, 278, 289
See application file for complete search history.

(56) References Cited

U.S. PATENT DOCUMENTS 6,062,949 A * 5/2000 Yashiki et al. ..... 451/10
6,935,930 B2 * 8/2005 Fujita ..... 451/41

FOREIGN PATENT DOCUMENTS

| | | | |
|---|---|---|---|
| JP | 4-99321 | A | 3/1992 |
| JP | 6-302569 | A | 10/1994 |
| JP | 10-294298 | A | 11/1998 |
| JP | 10294298 | A | 11/1998 |
| JP | 11-254306 | A | 9/1999 |
| JP | 11254306 | A | 9/1999 |
| JP | 2000-33558 | A | 2/2000 |
| JP | 2000-033558 | A | 2/2000 |
| JP | 2000-129227 | A | 5/2000 |
| JP | 2001-274121 | A | 10/2001 |
| JP | 2001-291689 | A | 10/2001 |
| WO | WO 99/33614 | | 7/1999 |
| WO | WO 99/33614 | A1 | 7/1999 |

* cited by examiner

*Primary Examiner*—Lee D. Wilson
*Assistant Examiner*—Anthony Ojini
(74) *Attorney, Agent, or Firm*—Oblon, Spivak, McClelland, Maier & Neustadt, P.C.

(57) ABSTRACT

The present invention is to provide a method and device for polishing a glass substrate, suitable for polishing a large-sized glass substrate.

The device for polishing a substrate is adapted so that a substrate is attached to a film stretched on a frame; the frame is installed on a carrier; the carrier and a polishing surface-plate are brought closer relative to each other to polish a surface to be polished of the substrate attached to the film by pressing the substrate to the polishing surface-plate; the frame is removed from the carrier after the completion of the polishing, and the polished substrate is removed from the frame.

5 Claims, 37 Drawing Sheets

METHOD AND APPARATUS FOR POLISHING A SUBSTRATE

This is a Divisional application of Ser. No. 11/045,089 filed Jan. 31, 2005 now U.S. Pat. No. 7,115,022 which is a CON of PCT/JP03/09745 filed Jul. 31, 2003 and claims priority to Japan 2002-223001 filed Jul. 31, 2002, the entire contents of which are incorporated herein by reference.

TECHNICAL FIELD

The present invention relates to a method and device for polishing a substrate. In particular, it relates to a method and device for polishing a glass substrate to manufacture a glass substrate for liquid crystal display.

BACKGROUND ART

A glass substrate used for liquid crystal display has minute recesses and projections or undulation in its surfaces, which causes a deformed picture image. Accordingly, such minute recesses and projections or undulation should be eliminated with a polishing device. As such polishing device, there has generally been known a polishing device in which a glass substrate held by a carrier is pressed to a polishing cloth disposed on a polishing surface-plate while the polishing surface-plate and the carrier are rotated relative to each other to polish the glass substrate.

Further, in the polishing device disclosed in JP-A-9-141550, a flexible film is disposed at a lower portion of the carrier and pressurized air is supplied between the flexible film and the carrier so that the pressure of the pressurized air urges the substrate attached to the flexible film to the polishing cloth for polishing. According to this polishing device, there is an advantage that the pressurized air in the space between the flexible film and the carrier applies pressure uniformly to each part of the substrate whereby the substrate can be polished flat, and minute recesses and projections in the substrate surface can be eliminated.

However, in the conventional polishing device, there is no proposal about a discharging means for discharging a glass substrate which has been polished and removed from the carrier, from a polishing stage. Particularly, in a case of a large-sized glass substrate, the length of a side of which is, for example, beyond 1,000 mm, the removal and handling of it in the polishing stage and the discharge of it from the polishing stage were very difficult and took a long time to thereby reduce productivity.

With the increase of the size of a liquid crystal display screen in recent years, a polishing device for a large-sized glass substrate, which can solve the above-mentioned problem of discharging a glass substrate after being polished and can improve productivity, has been expected.

The present invention has been made in consideration of the above-mentioned circumstances, and it is an object of the present invention to provide a method and device for polishing a glass substrate suitable for polishing a large-sized glass substrate.

DISCLOSURE OF THE INVENTION

In order to achieve the above-mentioned object, the method for polishing a substrate of the present invention is characterized by comprising a process for attaching a substrate to a frame with a film on which the film capable of attaching the substrate is stretched and installing the frame on a carrier, or a process for installing a frame on which a film capable of attaching a substrate is stretched on a carrier and attaching the substrate to the frame; a process for bringing the carrier holding the frame and a polishing surface-plate closer relative to each other and polishing a surface to be polished of the substrate attached to the film by pressing the substrate to the polishing surface-plate; and a process for removing the frame from the carrier after the completion of the polishing of the substrate and removing the substrate from the frame, or a process for removing the substrate from the frame after the completion of the polishing of the substrate and removing the frame from the carrier.

Preferably, the present invention is characterized by comprising a process for attaching a glass substrate to a frame on which a film capable of attaching a glass substrate is stretched, a process for installing on a carrier the frame to which the glass substrate is attached, a process for bringing the carrier with the frame and a polishing surface-plate closer relative to each other and polishing a surface to be polished of the glass substrate attached to the film by pressing the glass substrate to the polishing surface-plate, a process for removing the frame from the carrier after the completion of the polishing of the glass substrate, and a process for removing the polished glass substrate from the frame.

Further, in order to achieve the above-mentioned object, the polishing device of the present invention is characterized by comprising a substrate attaching stage for attaching a substrate to a frame on which a film capable of attaching the substrate is stretched;

a frame installing stage for installing the frame on a carrier; a polishing stage for polishing the substrate by bringing the carrier and a polishing surface-plate closer relative to each other after the installation of the frame on the carrier and pressing a surface to be polished of the substrate attached to the frame, to the polishing surface-plate; a substrate removing stage for removing the frame from the carrier, and a substrate removing stage for removing the polished substrate from the frame.

Preferably, the polishing device is characterized by comprising a glass substrate attaching stage for attaching a glass substrate to a frame on which a film capable of attaching the glass substrate is stretched, a polishing stage for polishing a surface to be polished of the glass substrate attached to the film by bringing the carrier and a polishing surface-plate closer relative to each other after the installation of the frame on the carrier and pressing the substrate to the polishing surface-plate, and a glass substrate removing stage for conveying the frame removed from the carrier after the completion of the polishing of the glass substrate and removing the polished glass substrate from the frame.

Further, according to the present invention, an unpolished glass substrate is attached to the film of a frame in the glass substrate attaching stage. Then, the frame to which the glass substrate is attached is installed on the carrier in the frame installing stage. In this case, the frame may be installed on the carrier in the frame installing stage and then, the unpolished glass substrate may be attached to the film of the frame in the glass substrate attaching stage.

Then, in the polishing stage, the carrier on which the frame is installed and the polishing surface-plate are brought closer relative to each other and the polishing is performed by pressing the surface to be polished of the glass substrate attached to the film to the polishing surface-plate.

Then, after the completion of polishing the glass substrate, the frame is conveyed from the polishing stage to the frame removing stage in which the frame is removed from the carrier, and thereafter, the polished glass substrate is removed from the frame in the glass substrate removing stage. In this case, the frame may be removed from the carrier in the frame removing stage after the polished glass substrate is removed from the frame in the glass substrate removing stage.

Thus, in the present invention, the glass substrate is attached to the frame capable of being attached to and detached from the carrier, and after the completion of the polishing, the polished glass substrate is removed from the frame in the glass substrate removing stage remote from the polishing stage, instead of removing the glass substrate from the frame in the polishing stage. With this measures, the present invention can solve the problem inherent in conveying a large-sized glass substrate and can improve productivity.

Further, in a preferred embodiment of the present invention, the frame is washed in the washing stage after the glass substrate is removed, and this frame can be used repeatedly for the attachment of another glass substrate. Accordingly, the number of frames to be prepared can be minimized, and accordingly, the present invention can contribute to resource saving.

According to another preferred embodiment of the present invention, pressurized fluid is supplied between the carrier and the film of the frame from a supply means for supplying pressurized fluid for polishing to create a pressure of pressurized fluid therebetween whereby the glass substrate is pressed for polishing to the polishing surface-plate. Since the pressure of pressurized fluid is applied uniformly to each part of the glass substrate, the glass substrate can be polished flat. Incidentally, the glass substrate is not influenced by the surface profile of the polishing surface-plate, i.e., even though the polishing surface-plate has some undulation in its surface. Therefore, the undulation is not transferred to the glass substrate. Accordingly, a strict requirement of precision to the polishing surface-plate is unnecessary, and cost for the polishing surface-plate can be reduced.

The film used preferably in the present invention has a three-layer structure comprising an air-tightness retention layer having a outer circumferential portion adhered tightly to the carrier to retain air-tightness between the film and the carrier, a strength retention layer holding the air-tightness retention layer and having a predetermined tensile stress durable to a tension for stretching the film, and a smooth layer to which the glass substrate is attached. Accordingly, the glass substrate can be held stably by the film whereby the glass substrate can be polished with accuracy.

In another embodiment of the present invention, the strength retention layer of the film is made of aramid fibers, a mesh of stainless steel, a mesh of steel, carbon fibers, glass fibers, nylon fibers or a material having the same tensile strength as these materials. Accordingly, the strength of the film can be assured when the glass substrate is pressed to the polishing surface-plate with a pressing force suitable for the polishing.

Further, according to another embodiment of the present invention, fluid is supplied from a supply means for supplying fluid for separating to the boundary between the film of the frame and an edge portion of the substrate in the substrate removing stage, whereby the substrate can be separated from the frame due to a separating function produced by the supply of the fluid. When the substrate is to be separated from the frame, it is possible to separate the substrate by its own weight. However, it takes much time. According to the present invention, the separating function is produced forcibly by supplying the fluid whereby the substrate can be separated from the frame in a shorter time to thereby increase productivity.

According to another embodiment of the present invention, a substrate is placed on a table in the substrate attaching stage, and then, the film of a frame is placed on the substrate on the table, and then, a press roller is pressed to the film placed on the substrate while the table and the press roller are moved relatively along the surface of the film by a moving means, whereby the substrate is attached to the film by the press roller.

The present invention can effectively be applied to a method and device for polishing a substrate, particularly, for polishing a substrate having a large surface area. In the production of a substrate having a small surface area, the substrate can be attached to a film without causing air bubbles between the substrate and the film by pressing simply the substrate to the film. The presence of air bubbles reduces the attaching strength. In order to obtain assured attaching, the amount of air bubbles should be minimized as possible. If the substrate having a large surface area is simply pressed to the film, a large amount of air bubbles exists because the degree of flatness of each of the film and the substrate is high. According to the present invention, the substrate and the film can be attached by pressing them with the press roller to discharge forcibly air bubbles existing between the film and the substrate. With this, the substrate of large surface area can certainly and firmly be attached to the film.

According to another preferred embodiment of the present invention, the frame is connected detachably to the carrier by means of a plurality of pins wherein a predetermined number of pins among the plurality of pins are fitted to be swung to the frame and the remaining pins are fixed thereto so as to be used for determining the position to the carrier.

The above-mentioned preferred embodiment of the present invention is also effective to the method and device for polishing a substrate, particularly, a substrate of large surface area. In the case that the frame and the carrier are connected, to determine mutual positions, by fitting a plurality of pins mounted on the frame to a plurality of openings formed in the carrier and that the frame is a small-sized frame, all the pins can be fitted to the openings even though these pins are mounted fixedly on the frame because accuracy in mounting the pins can easily be obtained. On the other hand, in the case of a large-sized frame to which a substrate of large surface area is to be attached, it is difficult to mount pins with accuracy. Accordingly, if all the pins are mounted fixedly, it is difficult to fit all the pins into the openings. On the other hand, if all the pins are mounted on the frame so that each pin can be swung with respect to its axis, an error of mounting can be absorbed by their swinging movement. Accordingly, all the pins can be fitted to the openings. However, if all the pins are mounted so as to be swung, it is impossible to determine the mutual positions because the frame can not be stable with respect to the carrier. Further, the pins have to resist against the shearing force of the polishing surface-plate at the time of the polishing. Accordingly, there is a possibility that they can not withstand against the shearing force.

According to the present invention, a predetermined number of pins among the plurality of pins are mounted on the frame so that they can be swung with respect to their axes, to absorb error in mounting each pin. The remaining pins are mounted fixedly on the frame to resist the shearing force to each of these pins applied from the polishing surface-plate. Accordingly, the large-sized frame can stably be connected to the carrier with accurate positional relation.

EXPLANATION OF NUMERALS

10, 300: polishing device, 12: conveyer, 14: frame, 16: stage (glass substrate attaching stage), 18: first polishing stage, 20: second polishing stage, 22: stage (glass substrate removing stage), 24: glass substrate discharging conveyer, 26: frame washing stage, 28: frame drying stage, 30: frame returning conveyer, 32: robot, 33: arm, 34: suction pad, 36: conveyer, 38: film, 40: upper frame, 42: lower frame, 44: air-tightness retention layer, 46: strength retention layer, 48: smooth layer, 50, 50A, 50B: polishing head, 51: casing unit, 52: carrier, 53: lower peripheral ring, 54: air chamber, 56: spindle, 58: polishing pad, 60: polishing pad, 62: polishing surface-plate, 64: rotary shaft, 66: polishing surface-plate, 68: rotary shaft, 70: rectilinear guide, 72: guide rail, 74: maintenance stage, 76: maintenance stage, 78: suspender ring, 80: penetration hole, 82: slide-contact ring, 84: slide-contact ring suspender, 86: upper spring, 88: spring for lifting, 90: penetration hole, 92: screw jack, 94: stopper pin, 96: line shaft, 98: jet orifice, 100: air chamber, 102: air supply channel, 104: valve, 106: air pump, 108: pin, 110: head portion, 112: hook, 114: pin, 116: recess, 118: stopper plate, 120: air passage, 122: clamper, 124: clamping plate, 126: pole, 128: penetration hole, 130: penetration hole, 132: pin supporting member, 134: penetration hole, 136: stopper pin, 138: conveyer, 140: robot, 142: arm, 144: suction head, 146: conveyer, 150, 152, 154: conveying device, 160: guide rail, 162: holder, 164: small-sized robot, 166: arm, 168: guide block, 170: guide rail, 200: table, 202: jack, 204: table, 206: air nozzle, 208: jack, 302: rail, 304: frame installing stage, 306: frame removing stage, 308: table, 310: plate attaching shuttle, 312: press roller, 314: plate separating shuttle, 316: elevating device, 320: table, 322: elevating device, 324: shuttle main body, 326: conveying table, 330: air nozzle (means for supplying fluid for separation), 340: pin, 342: opening, 344: tip portion, 346: thin portion, 350: hook, 352: fitting portion, 360: film pressing balloon, 362: head, 364: supporter, 366: cylinder unit

BEST MODE FOR CARRYING OUT THE INVENTION

In the following, preferred embodiments of the method and device for polishing a glass substrate of the present invention will be described with reference to the attached drawings.

Figure 1:
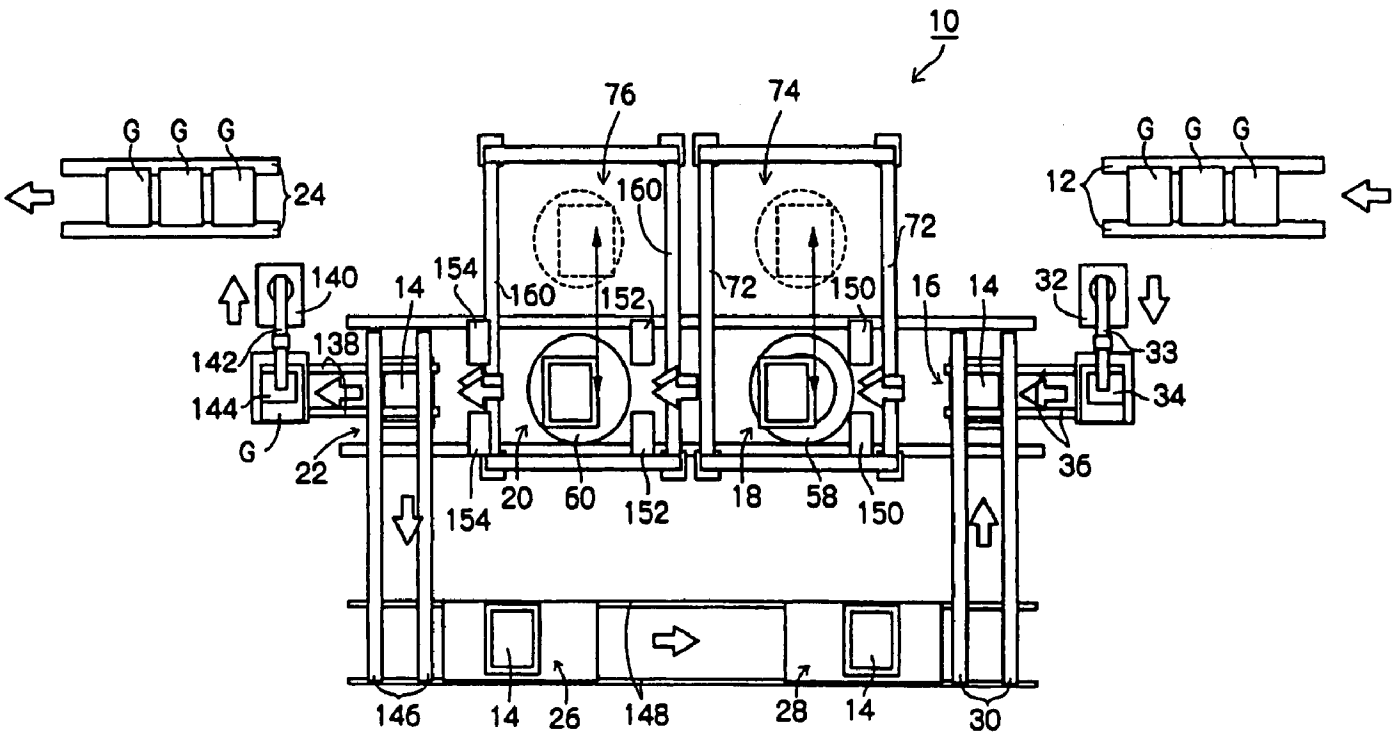
FIG. 1 is a plan view showing the entire structure of the polishing device according to a first embodiment.

In a first embodiment, a polishing device 10 is shown in FIG. 1, which is to polish a single surface of a large-sized glass substrate G (having, for example, a side exceeding 1,000 mm and a thickness of from 0.3 mm to 1.1 mm) to have a flatness necessary for a glass substrate used for liquid crystal display.

This polishing device 10 comprises mainly a conveyer 12 for conveying an unpolished glass substrate G, a stage 16 for attaching the glass substrate G to a frame 14 (glass substrate attaching stage), a first polishing stage 18, a second polishing stage 20, a stage 22 for removing the polished glass substrate G from the frame 14 (glass substrate removing stage), a glass substrate discharging conveyer 24, a frame washing stage 26, a frame drying stage 28 and a frame returning conveyer 30.

Further, the polishing device 10 is provided with a conveying device 150 for conveying the frame 14 from the stage 16 to the first polishing stage 18, a conveying device 152 for conveying the frame 14 from the first polishing stage 18 to the second polishing stage 20 and a conveying device 154 for conveying the frame 14 from the second polishing stage 20 to the stage 22. The number of polishing stages may be only one or more than two, which depends on intended use. In consideration of efficiency and cost, it is preferred to install two stages of a rough polishing stage and a fine polishing stage. However, if the case requires, the fine polishing stage may be added to obtain high quality.

An unpolished glass substrate G conveyed by the conveyer 12 is sucked and held by a suction pad 34 provided on the arm 33 of a robot 32, and it is transferred from the conveyer 12 to a conveyer 36 by a turning motion of the arm 33. Then, it is conveyed by the conveyer 36 to the stage 16. In the stage 16, the glass substrate G is attached to a frame 14. Description will be made as to the method of attaching. In the stage 16, the frame 14 is held on an elevating device (not shown) as a glass substrate attaching means. When the glass substrate G is positioned below the frame 14, the frame 14 is moved downward by means of the elevating device so that a film (see FIG. 3) stretched on the frame 14 is pressed to the glass substrate G. By this pressing force, the glass substrate G is attached to the film 38. Then, the frame 14 is held on the conveying device 150 in FIG. 1 and is conveyed to the first polishing stage 18 shown in FIG. 2, at which the frame is installed on a carrier 52. The glass substrate attaching means is not limited to the elevating device but any suitable means may be used as long as the glass substrate G can be attached to the frame 14. Here, the frame 14 described herein means the entirety including the stretched film 38.

Figure 3:
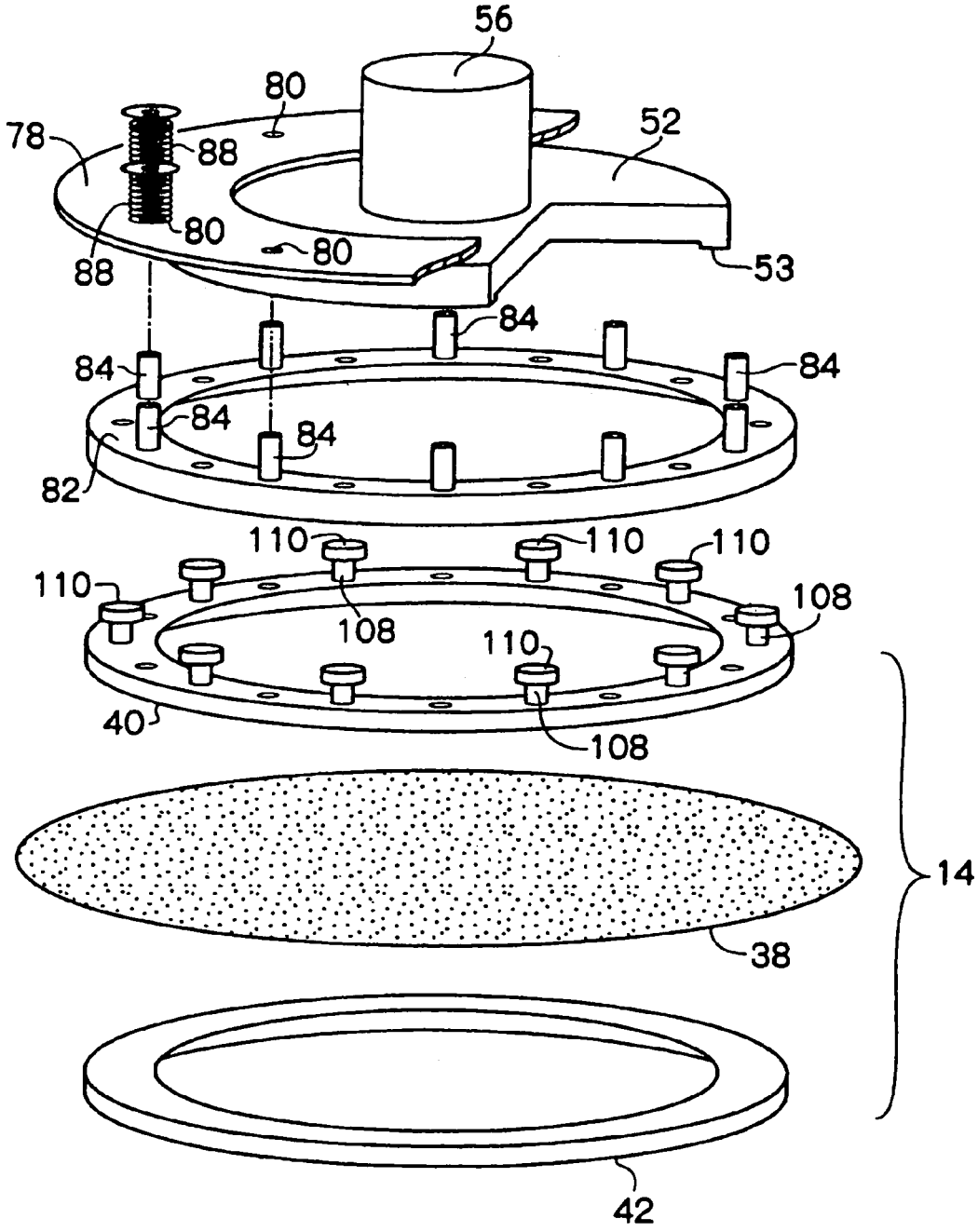
FIG. 3 is a perspective view of a polishing head disassembled.

As shown in FIG. 3, the frame 14 is constituted by stretching the film 38 which is adhesive to the glass substrate G between an upper frame 40 and a lower frame 42 and by fastening the upper frame 40 and the lower frame 42 by means of bolts (not shown).

The frame 14 and the film 38 are not limited to have a circular shape but they may have a rectangular shape.

Figure 4:
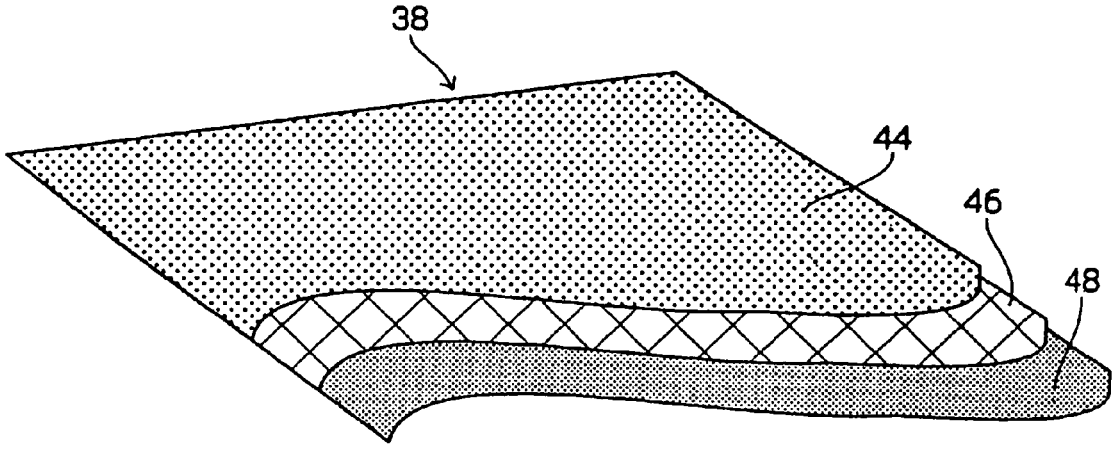
FIG. 4 is diagram showing the three-layer structure of a film to be attached to a frame.

The film 38 has a three-layer structure comprising an air-tightness retention layer 44, a strength retention layer 46 and a smooth layer 48 as shown in FIG. 4. The air-tightness retention layer 44 is a sheet material having its outer peripheral portion being adhered tightly to a lower peripheral ring 53 in the carrier 52 so as to maintain air-tightness of an air chamber 54 formed between the layer and the carrier 52. As the material for the sheet material, rubbers, silicons, fluorine resin, vinyls such as polyvinyl chloride (PVC), nylons and urethane may be mentioned. However, polyvinyl chloride or urethane is preferred from the standpoint of manufacturing. In particular, such one made of urethane is preferred. The strength retention layer 46 in FIG. 4 is a sheet material which can hold the air-tightness retention layer 44 and has a predetermined tensile strength durable to a tensile force for stretching the film 38.

Here, the tensile strength required for the strength retention layer 46 is calculated on the basis of a frictional force acting on the glass substrate G at the time of the polishing. When the glass substrate G have a size L, the frictional force acting on the glass substrate G at the time of the polishing is presented by "a friction coefficient of a polishing tool to the glass substrate G at the time of the polishing"×"a surface area per a unit width (cm) of the glass substrate G"×"pressure of polishing"=$\mu \times Lm \times 10^{-2} \times kPa$.

For instance, when $\mu=0.3$, L=1 m and p=3 kPa, $0.3\times10^{-2}\times3\times10^{3}=9N$.

Accordingly, the tensile strength required for the strength retention layer 46 needs to have a tensile force strong enough to the frictional force. Accordingly, in terms of a strip-like region having a unit width (1 cm) in the strength retention layer 46, a tensile strength of more than 9 N is required.

Assuming that a glass substrate having a large surface area is subjected to a high pressure of polishing, for example, when $\mu=0.5$, L=1.8 m and p=20 kPa, the tensile strength required for the strength retention layer 46 in this embodiment needs to have a tensile strength of at least 180 N in terms of a strip-like region having a unit width (1 cm) in the strength retention layer 46.

Rubber or resins are generally considered as the material for the strength retention layer 46. However, the strength retention layer is made of a material such as alamide fibers, a mesh of stainless steel, a mesh of steel, carbon fibers, glass fibers, nylon fibers, a metallic sheet, a resin sheet or the like so as not to cause the deformation in practical use wherein the tensile strength is at least 9 N/cm even in a case of L=100 cm and a pressure of pressing of about 3 kPa, particularly, the tensile strength is at least 180 N/cm in a case of L=180 cm from practical use and in addition, in consideration of an impact load. The particularly preferred material is alamide fibers because they have very small elongation to the tensile force.

Since the glass substrate G is rotated when it is polished actually, the maximum tensile force applied to the strength retention layer 46 is calculated based on the length of a diagonal line of the glass substrate G. In this embodiment, the calculation was made based on the length of a longer side of the glass substrate G in order to simplify the calculation.

The smooth layer 48 is constituted by bonding a glass-holding sheet used commonly to attach the glass substrate G. However, if the surface irregularity of the smooth layer 48 is large, there causes the problem that the surface irregularity is transferred to the glass substrate G at the time of polishing. Accordingly, the smooth layer 48 has to be flat and smooth. However, when resin or a rubber layer is applied by using a coating technique such as gluing, a local surface irregularity may take place. If this can not be avoided, a flat sheet can be formed by bonding a thin sheet according to a laminating process. The thin sheet may be of, for example, urethane, PVC, PET, PP as long as smoothness can be maintained. Urethane or PVC is preferred because a common laminating process can be used. In particular, a thin sheet of urethane is preferred. Specifically, the flatness of the smooth layer 48 be at most 0.1 mm per 100 $mm^2$ in terms of surface irregularity. In order to obtain a sufficient flatness, a plurality of smooth layers 48 may be overlaid. Further, the sheet thickness of the film 38 is preferably from about 0.1 mm to 5 mm in order to provide flexibility. Further, the thin sheet may be a porous sheet having a sucking function to the glass substrate G. In this case, the sucking function can be improved by forming previously a water film on the surface of the glass substrate G or the surface of the sheet.

The polishing pad of the polishing stage is generally subjected previously to truing to remove a minute undulation in the surface layer. For this purpose, a grinding unit for truing is generally installed in the polishing device. It is naturally for the grinding unit for truing to have a high precision because it provides the standard for the polished surface.

In this embodiment, the truing is carried out by attaching a commercially available sheet containing polishing powder to the film 38 of the frame 14 installed on the carrier 52. Namely, in the same manner as the polishing of the glass substrate G, the commercially available sheet attached to the film 38 of the frame 14 is pressed to the polishing pad of the polishing stage under the application of a uniform pressure by pressurized fluid, which is described later, while the sheet and the pad are moved relatively, whereby the truing of the polishing pad is carried out. This provides the advantage of eliminating a highly precise grinding unit. Incidentally, since the frame 14 attached with the polishing sheet instead of the glass substrate G can be put into the production line with a minimum interference to the production cycle, the interference to the production due to the truing can be controlled to the minimum.

Next, the polishing heads 50 shown in FIG. 2 will be described. The polishing head 50 of the first polishing stage 18 had the same structure as the polishing head 50 of the second polishing stage 20. Accordingly, the same reference numeral is used for these polishing heads.

Each polishing head 50 comprises a casing unit 51 including a motor, the output shaft of the motor being connected to a spindle 56 extending in a vertical direction. A carrier 52 is connected to the spindle 56. The casing unit 51 is connected to a slider 158 by a elevating devices 156. The elevating devices 156 move each casing unit 51 vertically with respect to each slider 158 whereby carriers 52 are advanced to or retracted from the polishing pad 58 of the first polishing stage 18 and the polishing pad 60 of the second polishing stage 20, and glass substrates G attached respectively to frames 14 can be pressed to respective polishing pads 58, 60 with a predetermined pressure of polishing.

The structure of an attaching/detaching means for attaching or detaching the frame 14 to the carrier 52 and the method for attaching or detaching are described later.

The polishing pad 58 is bonded to an upper face of a polishing surface-plate 62, and a lower portion of the polishing surface-plate 62 is connected with a rotary shaft 64 rotated by a motor not shown. The polishing pad 60 is bonded to an upper face of a polishing surface-plate 66, and a lower portion of the polishing surface-plate 66 is connected with a rotary shaft 68 rotated by a motor not shown. Here, the motors are not always necessary because there is a case that the polishing pads 58, 60 need not to be rotated. Instead, the polishing pads 58, 60 may be swung. In the description of the present invention, "polishing surface-plate" includes a combination of the polishing surface-plate 62 and the polishing pad 58 or a combination of the polishing surface-plate 66 and the polishing pad 60 in this embodiment.

Further, each casing unit 51 is connected to an orbital driving mechanism (not shown) so as to revolve with a predetermined radius of revolution. The orbital driving mechanism may include a planetary gear mechanism in the casing unit 51 so that the output shaft of the planetary gear mechanism is connected to the spindle 56. Specifications of the first polishing stage 18 and the second polishing stage 20 are described below.

Pressure of polishing: from 2 kPa to 25 kPa

Number of rotation of carrier 52: from 0 to 25 rpm, radius of orbital revolution: 100 mm (from 50 to 200 mm), number of orbital revolution: from 20 to 150 rpm or from 20 to 200 rpm Number of rotation of polishing surface-plates 62, 66: from 0 to 15 rpm Polishing slurry: an aqueous solution of cerium oxide is supplied through slurry supplying holes of the polishing surface-plates.

Polishing pad 58: made of urethane foam with grooves for feeding slurry in its front surface (groove pitch of from 5 to 10 mm, groove width of from 2 to 6 mm, groove depth of from 1 to 5 mm)

Polishing pad 60: made of suede-like flexible urethane with grooves for feeding slurry in its front surface (groove pitch of from 5 to 10 mm, groove width of from 2 to 6 mm, groove depth of from 1 to 5 mm)

Polishing time: from 1 to 10 min for both the first and the second polishing stages 18, 20

Swing motion of carriers 52 to polishing surface-plates 62, 66: from 0 to 700 mm in relative movement in a horizontal direction Thickness of glass substrate G: from 0.3 mm to 3.0 mm Shape of glass substrate G: rectangular glass sheet having a side exceeding 1,000 mm Surface without subjecting the polishing of a glass substrate G: held air-tightly with suction pads of polyurethane (glass holding sheets) attached to film 38

The above-mentioned are the specifications of each of the polishing stages 18, 20 by which the glass substrates G are polished and minute recesses and projections and undulation in the front surface of the glass substrates G can be removed.

Rectilinear guides 70, 70 are attached to the slider 158 of the first polishing stage 18. These rectilinear guides 70, 70 are respectively fitted to guide rails 72, 72. The guide rails 72, 72 are extended into a maintenance stage 74 in which the spindle 56 and the carrier 52 of the first polishing stage 18 undergo maintenance, as shown in FIG. 1.

Figure 2:
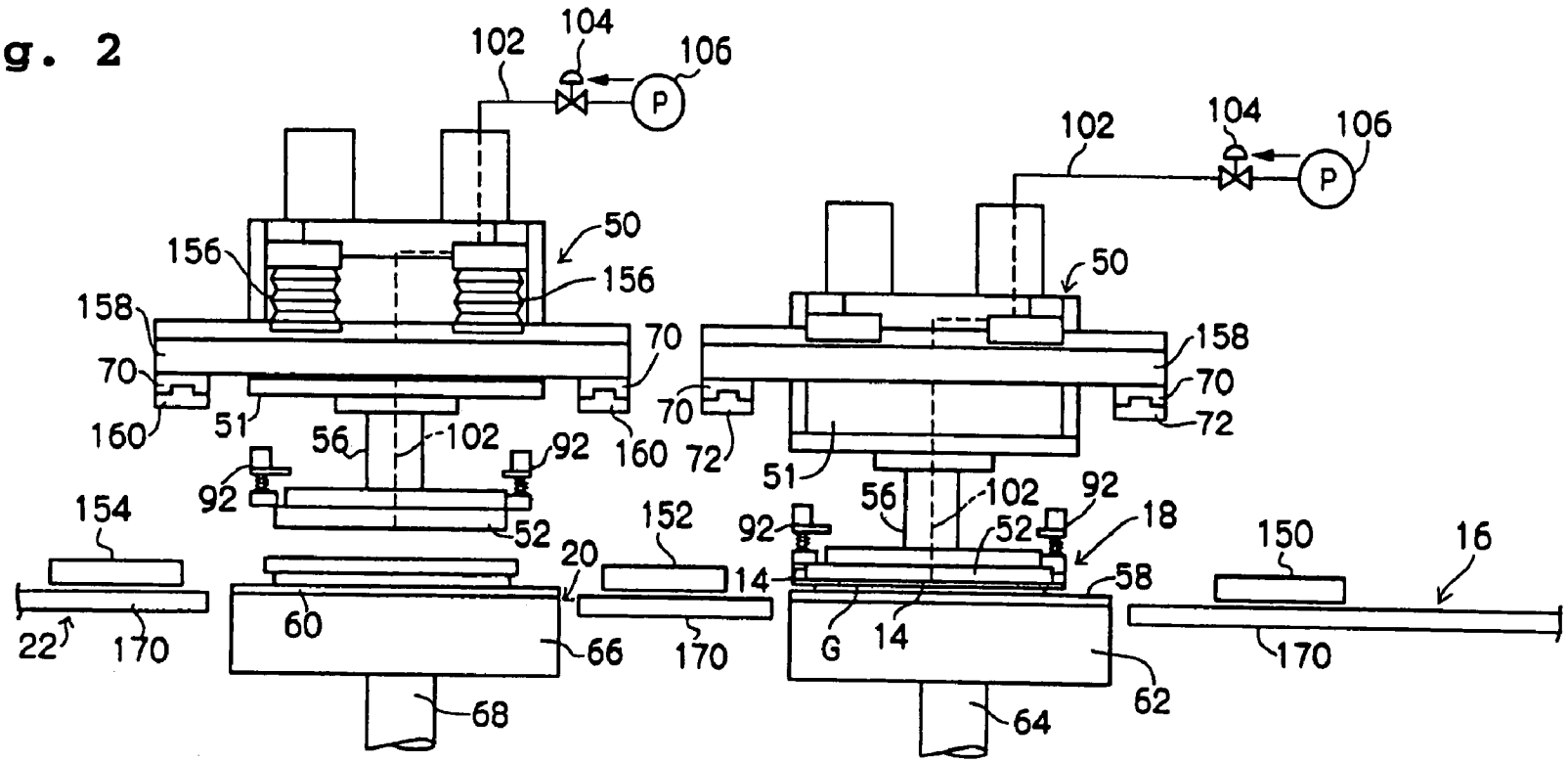
FIG. 2 is a side view showing polishing heads and polishing stages as an embodiment.

Similarly, rectilinear guides 70, 70 are attached to the slider 158 of the second polishing stage 20 as shown in FIG. 2. These rectilinear guides 70, 70 are respectively fitted to guide rails 160, 160. The guide rails 160, 160 are extended into a maintenance stage 76 in which the spindle 56 and the carrier 52 of the second polishing stage 20 undergo maintenance, as shown in FIG. 1.

Figure 5:
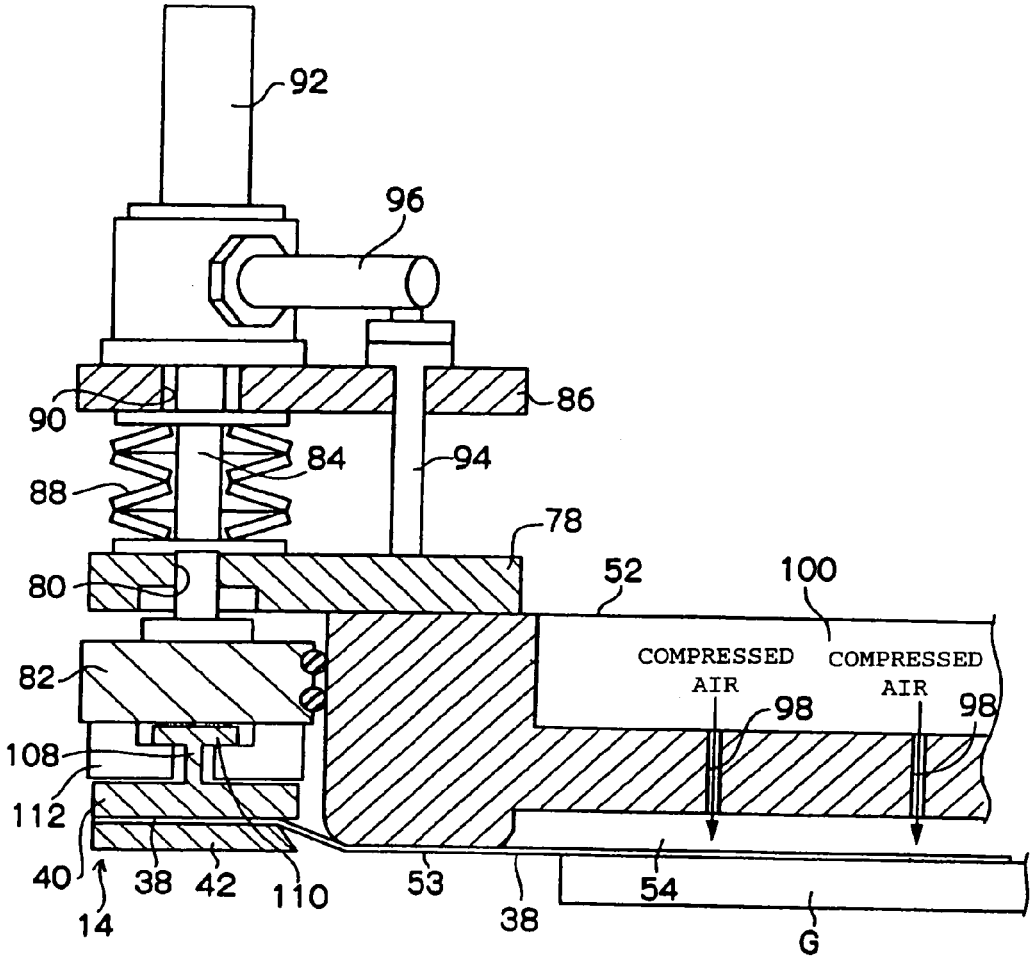
FIG. 5 is an enlarged cross-sectional view of an important portion showing an attaching/detaching structure for the frame to a slide-contact ring.

The structure of the carrier 52 will be described. A suspender ring 78 is provided at an upper peripheral portion of the carrier 52 and is fixed thereto by means of bolts (not shown) as shown in FIG. 3. In a flange portion of the suspender ring 78, which projects beyond the outer peripheral portion of the carrier 52, a plurality of penetration holes 80, 80 . . . are formed with equal intervals on a concentric circle, and slide-contact ring suspenders 84 provided on an upper face of the slide-contact ring 82 are penetrated upward into these penetration holes 80, 80 . . . as shown in FIG. 5. Further, each of the slide-contact ring suspenders 84 is inserted into a lifting spring assembly 88 disposed between the suspender ring 78 and a lifting disc spring 86; is also inserted into a penetration hole 90 of the lifting disc spring 86, and is connected to a screw jack 92.

Accordingly, when the screw jack 92 is operated to lift upward the slide-contact ring suspender 84 against the urging force of the suspender ring 88, the slide-contact ring 82 is lifted with respect to the carrier 52 whereby the frame 14 which is mounted on the slide-contact ring 82 so as to be attached or detached, is lifted so that a predetermined tensile force is exerted to the film 38.

In order to exert a tensile force to each film 38 automatically, a plurality of frames 14 and films 38 are prepared. In this case, there must consider that there is individual difference among initial tensile forces of films 38 with respect to frames 14, and there is difference among initial tensile forces of the films 38, 38 . . . , which are resulted from difference in time of use. Accordingly, it is difficult to exert the same tensile force to every film 38 having an individual difference of tensile force. Further, if an excessive tensile force is applied to a film 38, the film 38 or a peripheral device may be broken. In order to solve this, the quantity of shrinkage of the lifting spring assembly 88 (the distance between the suspender ring 78 and the lifting disc spring 86) should be monitored. Namely, the tensile force applied actually to the film 38 is measured by observing not only the quantity of lifting by the screw jack 92 but also the quantity of shrinkage of the lifting spring assembly 88. The provision of this lifting spring assembly 88 can solve simultaneously problems that a constant tensile force is applied to the film 38 and that an excessive tensile force is not applied to the film 38. In order to obtain a constant tensile force, it is necessary to measure the quantity of shrinkage of the lifting spring assembly 88. As one of techniques, the tensile force applied to the film 38 can be observed by calculating a torque of the screw jack 92 based on a current of the motor (not shown) connected to the screw jack via a line shaft 96 to obtain indirectly the lifting force of the screw jack 92 and by controlling the torque. The line shaft 96 is a shaft for transmitting the driving force of the motor to the screw jack 92. Reference numeral 94 designates a stopper pin which bears the reaction force of the lifting spring assembly 88, the reaction force generating between the suspender ring 78 and the lifting disc spring 86.

A plurality of jet orifices 98, 98 . . . for discharging compressed air into the air chamber 54 are formed in the carrier 52. These jet orifices 98, 98 . . . are communicated with an air supply channel 102, indicated by a broken line in FIG. 2, via an air chamber 100 formed in an upper face of the carrier 52. The air supply channel 102 is extended to the outside of each polishing head 50 via a rotary joint (not shown) attached to the polishing head 50 and is connected to an air pump 106 through a valve 104. Accordingly, when the value 104 is opened, compressed air is supplied from the air pump 106 to the air chamber 54 through the air supply channel 102, the air chamber 100 and the jet orifices 98. Thus, the pressure of the compressed air is transmitted to the glass substrate G through the film 38 whereby the glass substrate G is pressed to the polishing pad 58 (60) to be polished.

Next, the structure of the attaching/detaching means for attaching the frame 14 to the slide-contact ring 82 or detaching the frame 14 from the slide-contact ring 82 will be described.

As shown in FIG. 3, a plurality of pins 108, 108 . . . are projected from an upper frame 40 of the frame 14 with equal intervals on a concentric circle. At the upper edge portion of each of the pins 108, a large-sized head portion 110 is formed. Each head portion 110 is engaged with each hook 112 fixed to a lower portion of the slide-contact ring 82 whereby the frame 14 is attached to the slide-contact ring 82 as shown in FIG. 5. The engaging force between the head portion 110 and the hook 112 is increased by the reaction force of the film 38 when the film 38 is stretched by the screw jack 92. Accordingly, there is no danger of disengaging of the head portion 110 from the hook 112 by the resistance of polishing given by the film 38 at the time of polishing.

Figure 6B:
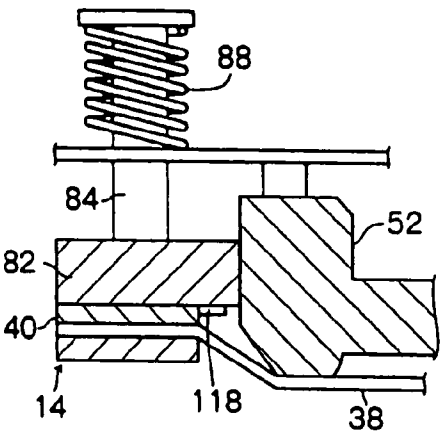
FIG. 6 shows enlarged cross-sectional views of important portions showing other attaching/detaching structures for the frames to slide-contact rings.
Figure 6A:
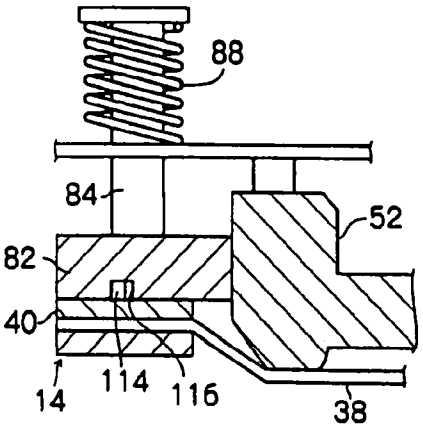

The attaching/detaching structure of the frame 14 with respect to the slide-contact ring 82 is not limited to the structure as shown in FIG. 5, but it may have such a structure that the slide-contact ring 82 is made of a magnetic material, the upper frame 40 of the frame 14 is made of a magnet, and the frame 14 is attracted to the slide-contact ring 82 and held thereto by a magnetic force, for example, as shown in FIG. 6(A). In this structural example, a pin 114 is provided on the upper frame 40 so as to be inserted in a hole 116 formed in a lower face of the slide-contact ring 82 whereby a horizontal movement of the frame 14 to the slide-contact ring 82 is prevented.

In the structural example shown in FIG. 6(B), a frame 14 is attracted to a slide-contact ring 82 and is held thereto by a magnetic force in the same manner as FIG. 6(A). An inner peripheral surface of an upper frame 40 of the frame 14 is made contact with a stopper plate 118 attached to a lower surface of the slide-contact ring 82 whereby a horizontal movement of the frame 14 to the slide-contact ring 82 is prevented.

Figure 6E:
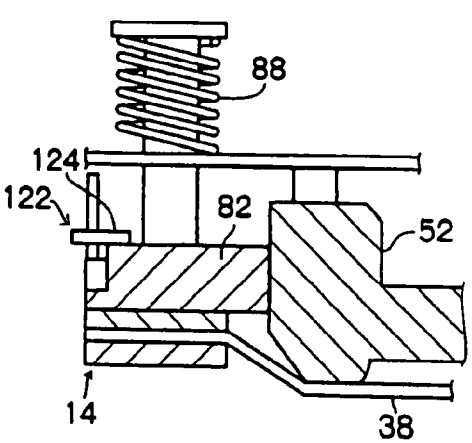
Figure 6D:
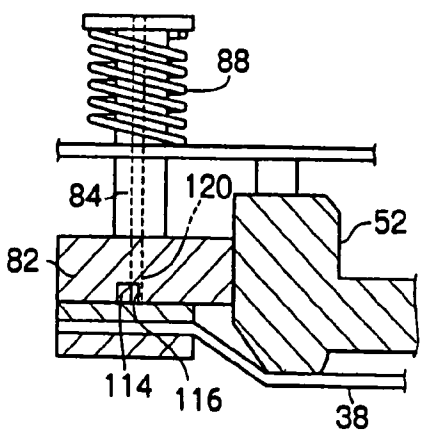
Figure 6C:
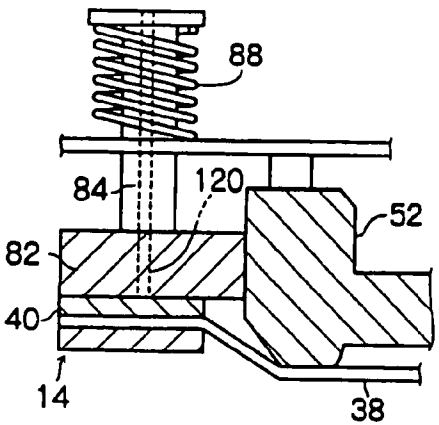

In the structural example shown in FIG. 6(C), an air passage 120 is formed in a slide-contact ring 82 and a suction pump is connected to the air passage 120. The frame 14 is attracted to and held by the slide-contact ring 82 by sucking the upper frame 40 of the frame 14 through the air passage 120.

In the structural example shown in FIG. 6(D), a frame 14 is held to a slide-contact ring 82 by a sucking force in the same manner as FIG. 6(C). A pin 114 of an upper frame 40 is inserted into a recess 116 in the slide-contact ring 82 whereby a horizontal movement of the frame 14 to the slide-contact ring 82 is presented.

In the structural example shown in FIG. 6(E), a clamper 122 is disposed in an outer peripheral portion of a frame 14 and an outer peripheral portion of a slide-contact ring 82 is clamped between the clamping plate 124 of the clamper 122 and the frame 14 whereby the frame 14 is attached to the slide-contact ring 82.

Figure 7B:
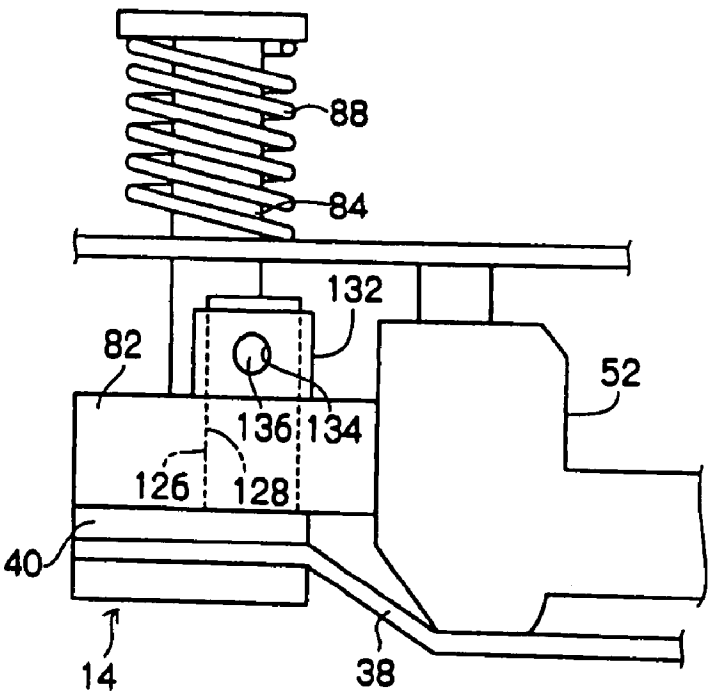
FIG. 7 shows enlarged views of important portions showing other attaching/detaching structures for the frames to slide-contact rings.
Figure 7A:
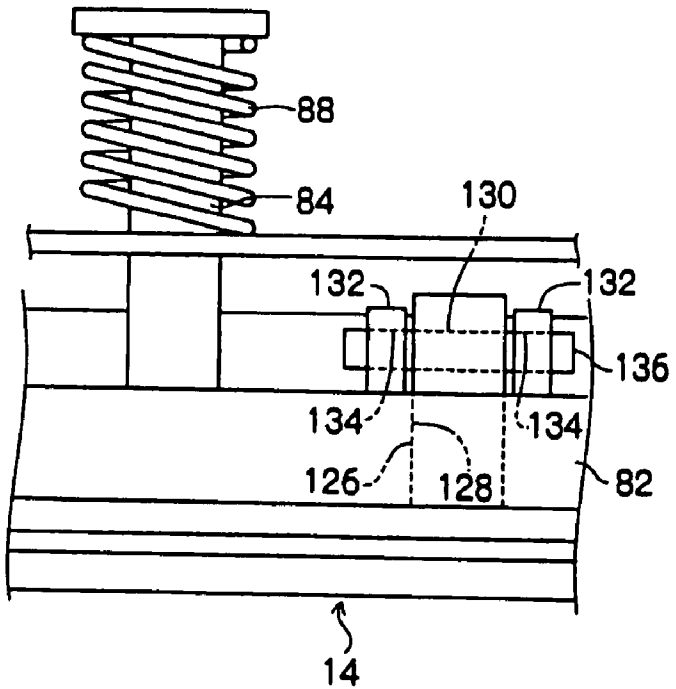

In the structure shown in FIGS. 7(A) and 7(B), a pole 126 is provided on an upper frame 40 of a frame 14. This pole 126 is inserted in a penetration hole 128 formed in a slide-contact ring 82. A penetration hole 130 is formed in an upper end portion of the pole 126. A pair of pin supporters 132, 132 each having a penetration hole 134 are fixed on an upper face of the slide-contact ring 82. A stopper pin 136 is inserted in the penetration hole 130 of the pole and penetration holes 134, 134 of the pin supporters. Thus, the frame 14 is held by the slide-contact ring 82.

In FIG. 7, the frame 14 is lifted upward along with the slide-contact ring 82 with a predetermined tensile force by an urging force of a lifting spring 88. Even though a creep elongation generates in the film 38, the film 38 is always subjected to a predetermined tensile force by the urging force of the lifting spring. The lifting spring 88 may be replaced by a unit such as hydraulic cylinder, air cylinder, disc spring, leaf spring or the like as long as a tensile force is applied to the film 38 automatically even though a creep elongation generates in it. For the purpose of automation, an actuator such as cylinder, motor or the like may be used.

The polishing of the glass substrate G is carried out by conveying the glass substrate G from the stage 16 to the first polishing stage 18 by the conveying device 150, and by a conveying sequentially the glass substrate G from the first polishing stage 18 to the second polishing stage 20 by the conveying device 152. When the polishing of the glass substrate G is finished in the second polishing stage 20, the frame 14 is removed from the carrier 52, and it is conveyed to the stage 22 by the conveying device 154. The method for removing the frame 14 from the carrier 52 is described. First, the screw jack 92 as shown in FIG. 5 is operated to reduce the tensile force of the film 38. Then, the frame 14 is turned by a predetermined angle with respect to the carrier 52 to disengage the head portion 110 from the hook 112. Thus, the frame 14 can be removed from the carrier 52.

Figure 8:
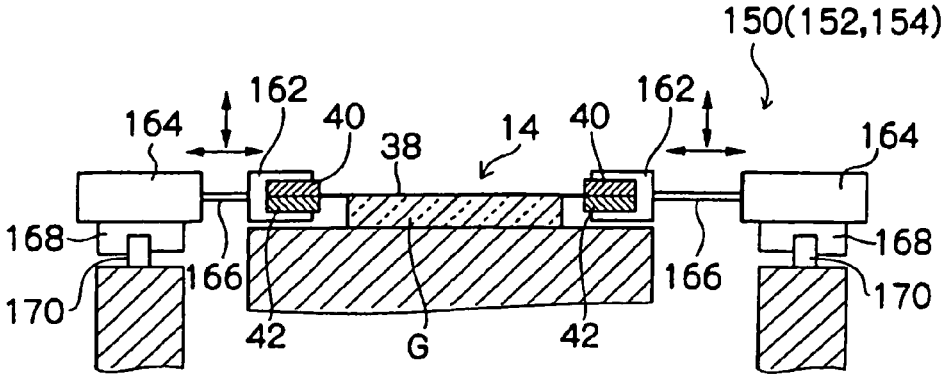
FIG. 8 is a schematic structural view of a conveying device for a glass substrate.
Figure 9A:
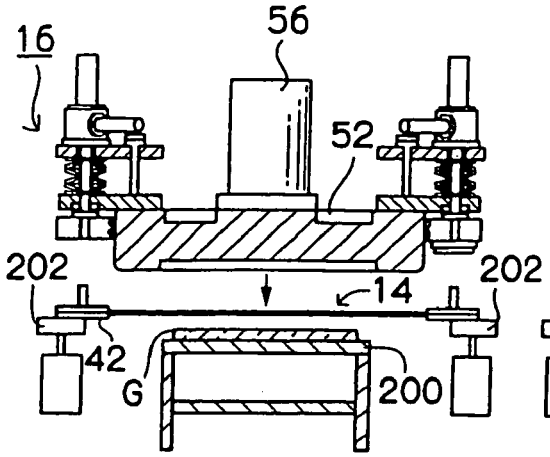
FIG. 9 is a diagram showing a glass substrate attaching process as well as a frame and a carrier.
Figure 9B:
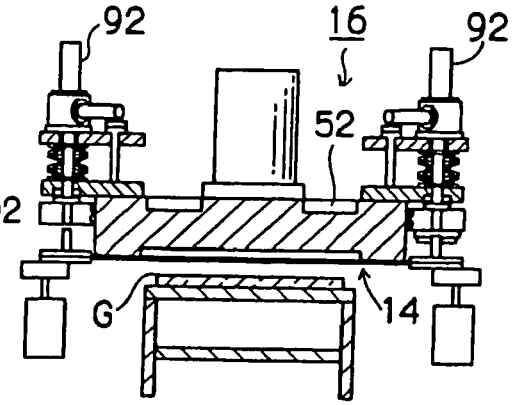
Figure 9C:
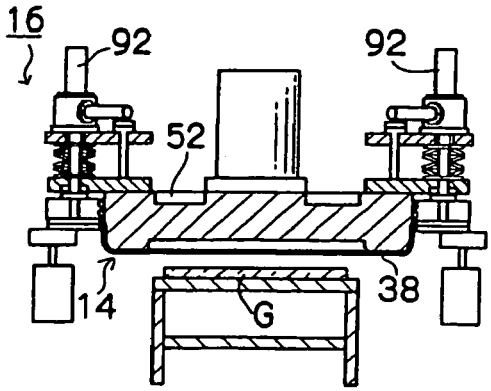
Figure 9D:
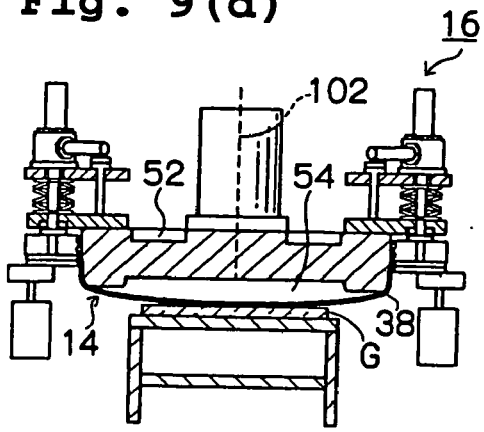
Figure 9E:
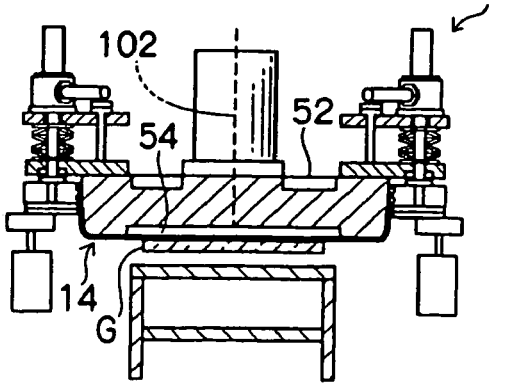
Figure 10A:
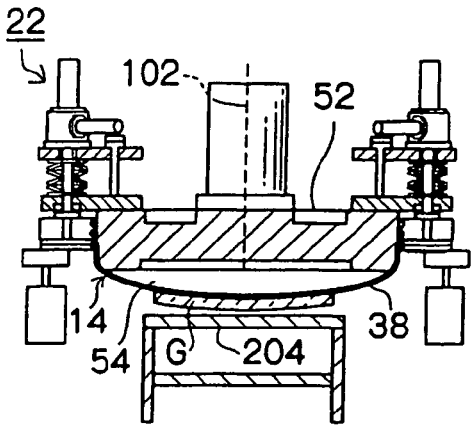
FIG. 10 is a diagram showing a separating process for separating a glass substrate from a frame.
Figure 10B:
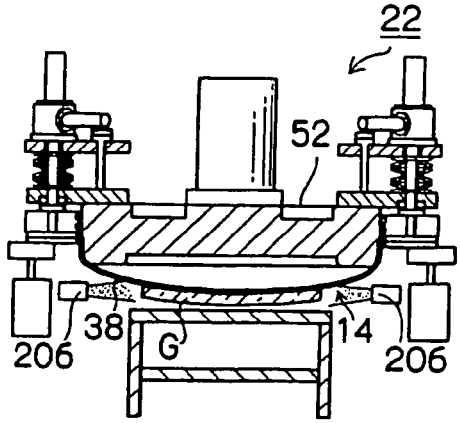
Figure 10C:
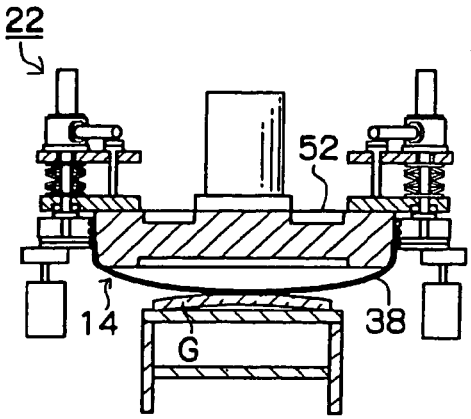
Figure 10D:
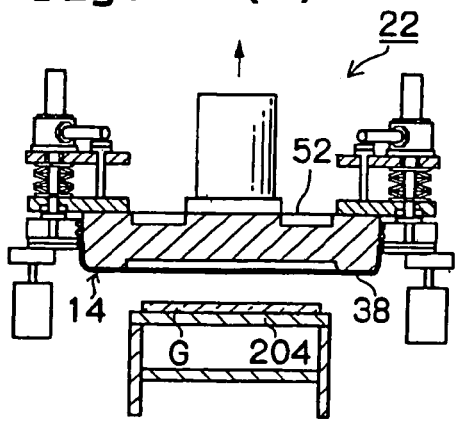
Figure 10E:
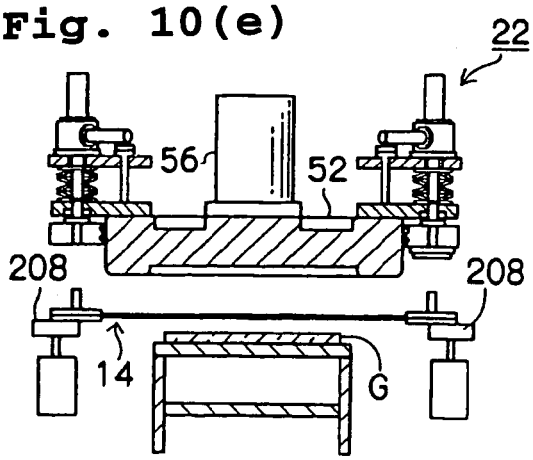

FIG. 8 shows an example of the conveying device 150 (152, 154). This conveying device 150 has holders 162, 162 for holding the upper frame 40 and the lower frame 42 of the frame 14. These holders are arranged at both sides of the conveying route for the frame 14 and they are connected respectively to arms 166 of small robots 164 so that the holders are moved vertically and horizontally by the movement of the arms 166. A guide block 168 is fixed to a lower portion of each small robot 164, and this guide block 168 is fitted to each guide rail 170 which is arranged at each side of the conveying route for the frame 14. Further, the feed screw of a feed screw unit (not shown) is engaged with each of the guide blocks 168 whereby the glass substrate G is held by the conveying device 150 (152, 154) and is conveyed to a predetermined position.

On the other hand, in the stage 22 shown in FIG. 1, the glass substrate G to which the polishing is finished is removed from the frame 14 conveyed by the conveying device 154. The removed glass substrate G is conveyed by a conveyer 138 and is sucked to a suction head 144 attached to an arm 142 of a robot 140. The robot 140 transfers the glass substrate onto the glass substrate discharging conveyer 24 to be discharged outside the polishing device 10.

The frame 14 from which the glass substrate G is removed is conveyed to the frame washing stage 26 by means of a conveyer 146 to be washed with water. The washed frame 14 is conveyed to the frame drying stage 28 by a conveyer 148, in which it is heated and dried. Then, the dried frame 14 is conveyed to the stage 16 by the frame returning conveyer 30 to be used again for attaching another glass substrate G.

According to the polishing device 10 for the glass substrate G, constructed as mentioned above, after the completion of the polishing of the glass substrate G in the second polishing stage 20', the frame 14 is conveyed from the second polishing stage 20 to the stage 22 by the conveying device 154, and in the stage 22, the polished glass substrate G is removed from the frame 14. Namely, the polishing device 10 of this embodiment is not constituted so that the glass substrate G is attached to the frame 14 to be attached to or detached from the carrier 52, and after the completion of the polishing, the glass substrate G is removed from the frame 14 in the second polishing stage 20, but is constituted so that the polished glass substrate G is removed from the frame 14 in the stage 22 located apart from the second polishing stage 20. Accordingly, it is possible to solve the problem of discharging a special glass substrate G such as a large-sized glass substrate having, for example, a side exceeding 1,000 mm (the problem that it is very difficult to removing the glass substrate in the polishing stage, handling and discharging it, whereby it takes a long time, and therefore, productivity is decreased). Thus, productivity can be improved.

Further, in the polishing device 10, the frame 14 from which the glass substrate G is removed is washed in the frame washing stage 26, is dried in the frame drying stage 28, then, is conveyed to the stage 16, and is used repeatedly for attaching glass substrates G. Accordingly, it is enough to prepare the minimum necessary number of frames 14. This contributes resource saving.

Further, according to the polishing device 10, compressed air is supplied from the air pump 106 to the space between the carrier 52 and the film 38 of the frame 14 so that the glass substrate G is pressed to the polishing pad 58 (60) for polishing by the pressure of the compressed air. Accordingly, each portion of the glass substrate G is applied with a uniform pressure whereby the glass substrate G can be polished flat. Further, the polishing is not influenced by the surface configuration of the polishing pad 58 (60). Namely, even though the front surface of the polishing pad 58 (60) has more or less undulation, there is no danger that the undulation is transferred to the glass substrate G. Accordingly, it is unnecessary to finish precisely the polishing pads 58 (60), and therefore, cost for the polishing pads 58 (60) can be suppressed.

Further, the film 38 of the frame 14 has a three-layer structure comprising the air-tightness retention layer 44, the strength retention layer 46 and the smooth layer 48. Accordingly, the glass substrate G can be held stably on the film 38, and therefore, the glass substrate G can be polished with precision.

Further, the strength retention layer 46 is made of alamide fibers, a mesh of stainless steel, a mesh of steel, carbon fibers, glass fibers, nylon fibers, a metal sheet, a resin sheet or a material having the same tensile strength as these materials. Accordingly, when the glass substrate G is pressed to the polishing pads 58 (60) with a pressing force suitable for the polishing, the strength of the film 38 can be assured.

Here, the tensile strength described herein indicates a tensile strength ruled in JIS L1096 (1999) or the standard pursuant thereto, when the strength retention layer 46 is made of fabric, and indicates a tensile strength used commonly when it is made of a resin sheet or metal sheet (for example, JIS K7161 (1994) in a case of plastics, or a standard pursuant thereto, the same as in the case of metal).

FIG. 9 shows another example of the process for attaching a glass substrate G to a frame 14 with respect to a carrier 52. This attaching process is carried out in the stage 16.

As shown in FIG. 9(*a*), an unpolished glass substrate G is placed on a table 200 provided in the stage 16, and the frame 14 is supported above by means of jacks 202, 202. On the other hand, the carrier 52 is above the frame 14 in a standby state. This state is an initial state of attaching. FIG. 9(*b*) shows a state that the carrier 52 is moved downward from the initial state of attaching to contact the frame 14. This state is a state of initiating the attachment of the frame 14 by utilizing screw jacks 92 or the like.

Then, as shown in FIG. 9(*c*), the head portion 110 of the pin 108 (see FIG. 5) of the frame 14 is engaged with the hook 112 fixed to the lower portion of the slide-contact ring 82. Then, the screw jacks 92 are driven to stretch the film 38 of the frame 14 to have a predetermined tensile force. Thus, the frame 14 is attached to the carrier 52.

FIGS. 9(*d*) and 9(*e*) show the process for attaching the glass substrate G to the film 38 of the frame 14. First, as shown in FIG. 9(*d*), air is supplied to the air chamber 54 via the air supply channel 102 to inflate the film 38 so that the film 38 is attached to the entire surface of the glass substrate G. When the attaching is completed, air in the air chamber 54 is released through the air supply channel 102 to shrink the film 38 as shown in FIG. 9(*e*). Thus, both the operation of attaching the frame 14 to the carrier 52 and the operation of attaching the glass substrate G to the frame 14 can be carried out in a single stage 16.

FIG. 10 shows the process for removing a polished glass substrate G from a frame 14, the process being carried out in the stage 22.

As shown in FIG. 10(*a*), when the carrier 52 is located above a table 204 located in the stage 22, air is supplied to an air chamber 54 via an air supply channel-102 to inflate the film 38. This state is an initial state for separating the glass substrate G. By causing this state, the glass substrate G can easily be separated from the film 38 due to a relative change of position between the glass substrate G and the film 38 and the elastic force of glass substrate G by which the glass substrate tends to be flat. Namely, the process for separating the substrate, which conventionally imposed a burden to the equipment for separating, can be easy by inflating the film 38.

In this embodiment, an attempt is made to shorten the tact. Namely, as shown in FIG. 10(*b*), water and air, or only water, or only air (fluid) is injected through a plurality of air jet nozzles 206, 206 (which may be water jet nozzles, as supply means for supplying fluid for separation) which are arranged at opposed positions with respect to edge portions of the glass substrate G, to the boundary between the edge portions of the glass substrate G and the film 38. Thus, the glass substrate G is separated from the film 38 by the energy of the injection as shown in FIG. 10(*c*) although the nozzles 206 are omitted in FIG. 10(*c*).

FIG. 10(*d*) shows a state that the glass substrate G is separated completely from the film 38 and is placed on the table 204. Then, the glass substrate G is conveyed by the conveyer 138 shown in FIG. 1, is transferred on the glass substrate discharging conveyer 24 by means of a robot 140, and is discharged outside the polishing device 10.

On the other hand, when the glass substrate G is separated completely from the film 38 as shown in FIG. 10(*d*), the frame 14 is removed from the carrier 52 by means of a removing device to place it on jacks 208, 208 as shown in FIG. 10(*e*). This frame 14 is conveyed to the frame washing stage 26 by the conveyer 146 shown in FIG. 1.

Figure 11:
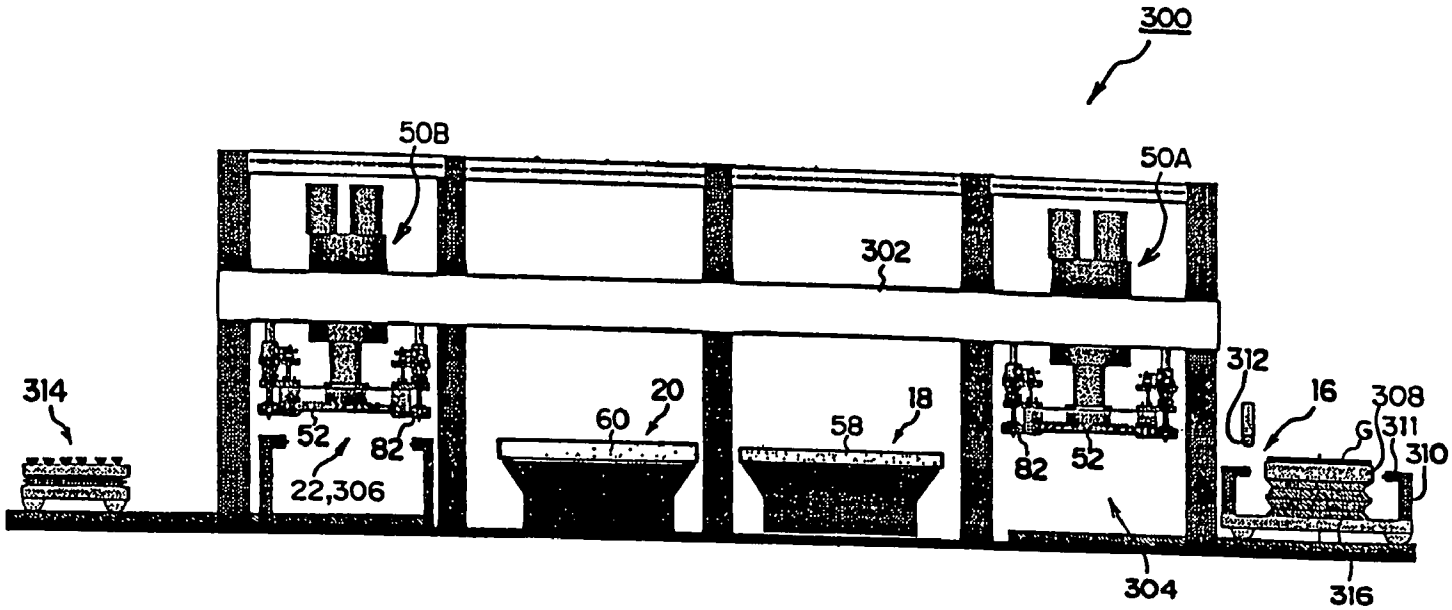
FIG. 11 is a front view of the polishing device according to a second embodiment.

FIG. 11 is a front view of a polishing device 300 according to a second embodiment wherein the same reference numerals designate the same or similar parts as the polishing device 10 according to the first embodiment shown in FIGS. 1 to 10.

The characteristic feature of the polishing device 300 shown in FIG. 11 resides in that two polishing heads 50A, 50B are moved horizontally along a rail 302 to transfer the frame 14 (see FIG. 3) to not only from the first polishing stage 18 to the second polishing stage 20 but also from a frame installing stage 304 to the first polishing stage 18 and from the second polishing stage 20 to a frame removing stage 306. With this, the tact for manufacture can be improved.

The polishing device 300 comprises mainly a plate attaching shuttle 310 with a table 308 on which an unpolished glass substrate G is placed, a glass substrate attaching stage 16 having a press roller 312, a frame installing stage 304 for installing the frame 14 on the carrier 52, a first polishing stage 18, a second polishing stage 20 and a frame removing stage 306 for removing the frame 14 from the carrier 52. The frame removing stage 306 serves as a glass substrate removing stage 22 in which the polished glass substrate G is removed from the frame 14. Reference numeral 314 designates a plate separating shuttle for discharging the polished glass substrate G from the glass substrate removing stage 22. The polishing device 300 is also provided with a frame washing stage, a frame drying stage and a frame returning conveyer in the same manner as the polishing device 10 although these elements are omitted in FIG. 11.

In the following, the sequence of polishing the glass substrate G by the polishing device 300 will be described.

On the table 308 of the plate attaching shuttle 310 in the glass substrate attaching stage 16 in a standby state, a glass substrate G conveyed by a robot (not shown) is placed so that the surface to be polished faces downward. The table 308 is mounted on the plate attaching shuttle 310 by interposing an elevating device 316. When the glass substrate G is placed on the table, the elevating device is elongated so that the table projects slightly from an upper edge portion 311 of the shuttle on which the frame 14 is placed. The upper edge portion 311 has the shape corresponding to the shape of the frame 14. Namely, when the frame 14 is rectangular, it has also a rectangular shape.

Figure 12:
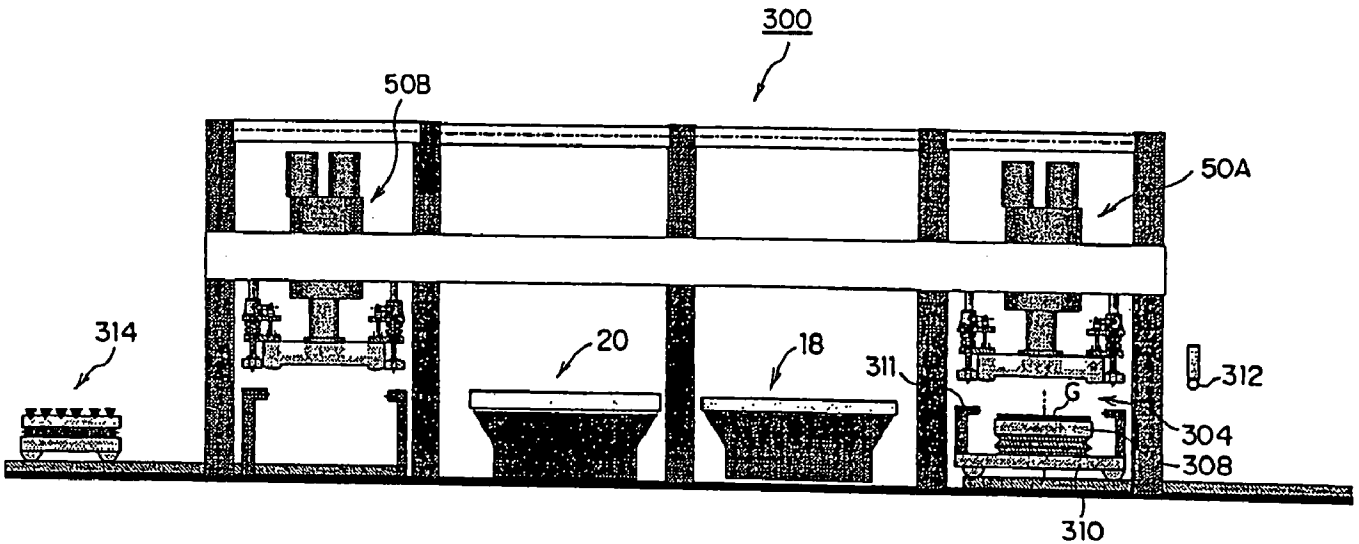
FIG. 12 is a diagram showing an operation of the polishing device shown in FIG. 11.

Then, the plate attaching shuttle 310 is moved from the glass substrate attaching stage 16 to the frame installing stage 304 and the table 308 is moved lower than the upper edge portion 311 of the plate attaching shuttle 310 so as not to interfere the positioning of the frame 14 as shown in FIG. 12. Then, in the frame installing stage 304, the frame 14 conveyed by the frame returning conveyer (not shown) is placed on the upper edge portion 311 of the plate attaching shuttle 310 so that the film 38 of the frame 14 is positioned above the glass substrate G. In this case, it is preferable to provide a plurality of guide rollers on the upper edge portion 311 in order to make the positioning of the frame 14 easy.

Figure 13:
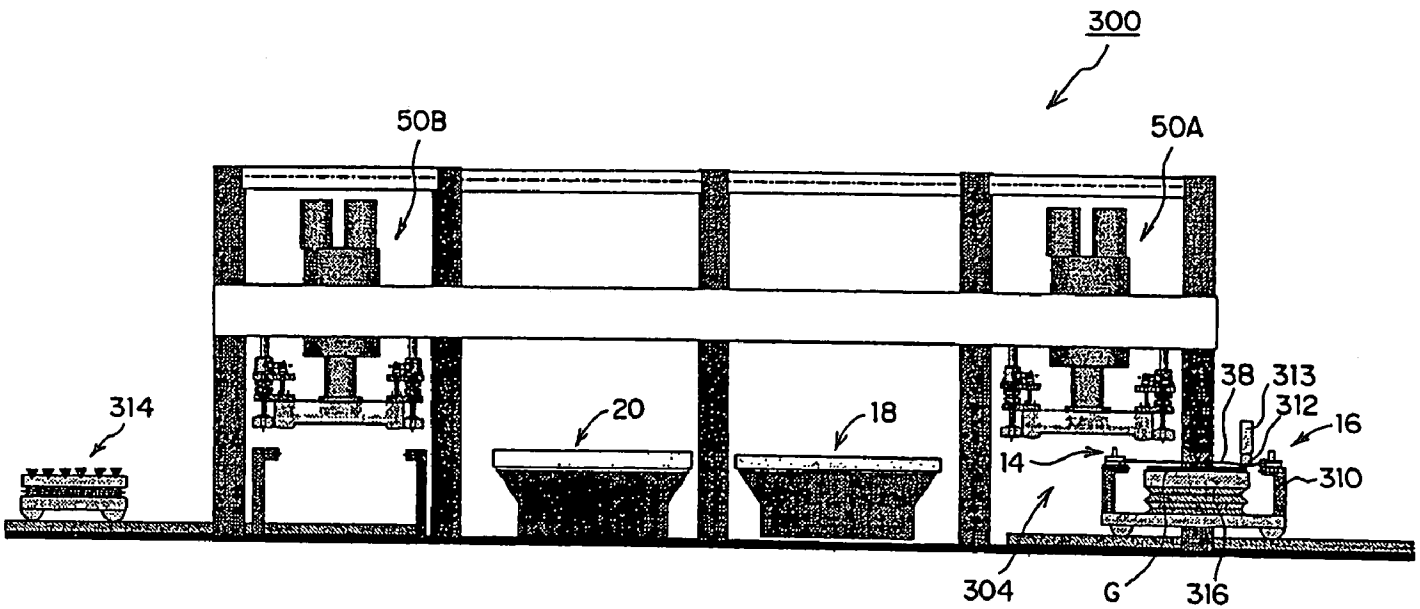
FIG. 13 is a diagram showing an operation of the polishing device shown in FIG. 11.
Figure 14:
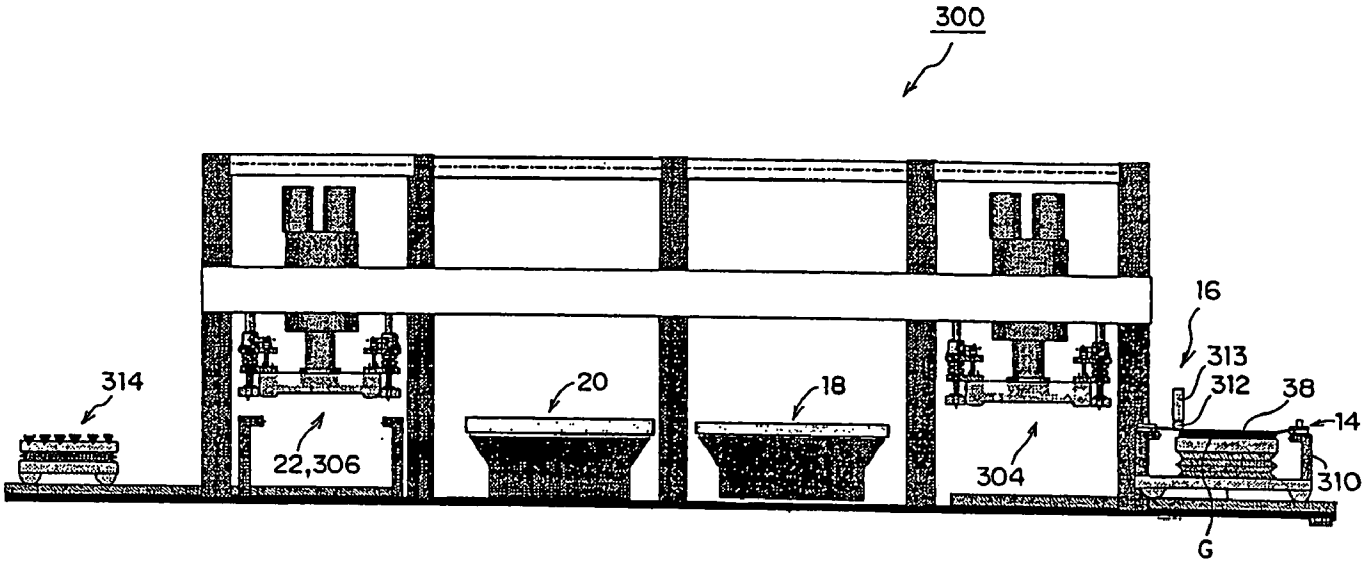
FIG. 14 is a diagram showing an operation of the polishing device shown in FIG. 11.
Figure 15:
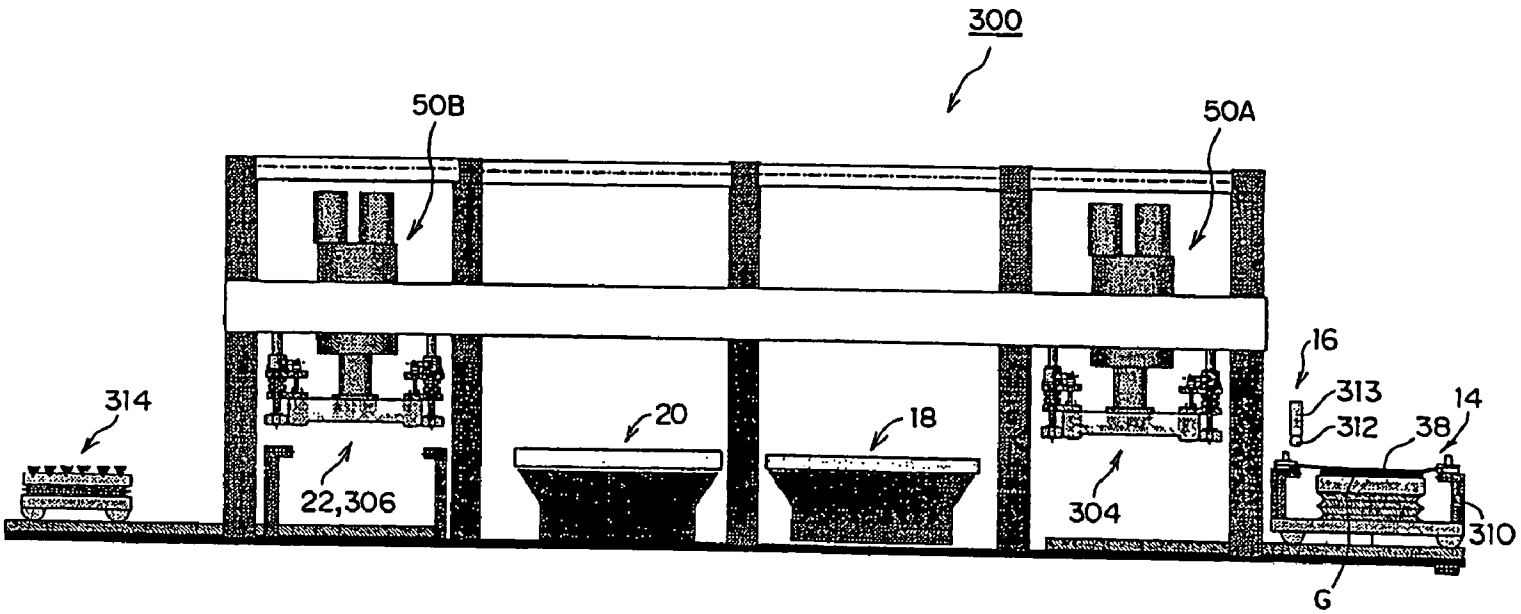
FIG. 15 is a diagram showing an operation of the polishing device shown in FIG. 11.

When the plate attaching shuttle 310 receives the frame 14, the shuttle 310 is moved to the glass substrate attaching stage 16 as shown in FIG. 13. In association with this moving action, the press roller 312 positioned above the glass substrate attaching stage 16 in a standby state is descended by the extension of a cylinder unit 313 to press the film 38 to the glass substrate G. This press roller 312 has a longer width than the width of the glass substrate G (the length in a direction perpendicular to the moving direction). The operational timing of the attaching is controlled by a controller (not shown) so that the film 38 is pressed to the glass substrate G on the moving plate attaching shuttle 310 just before the front edge portion of the moved glass substrate G passes just below the press roller 312. Further, the press roller 312 continues the pressing operation until the rear edge portion of the moved glass substrate G on the plate attaching shuttle 310 passes away as shown in FIG. 14. The operational timing of the press roller is controlled by the controller so that it is retracted upward from the pressing position to the film 38 as shown in FIG. 15.

With the pressing operation of the press roller 312 and the movement of the plate attaching shuttle 310, the film 38 is attached to the glass substrate G in the glass substrate attaching stage 16 without causing air bubbles between the film 38 and the glass substrate G.

The attaching of the glass substrate G with use of the press roller 312 is effective for a polishing device for polishing, in particular, a large-sized glass substrate. In the case of a small-sized glass substrate, the glass substrate can be attached to the film 38 without causing air bubbles between the glass substrate and the film 38 by pressing simply the film 38 to the glass substrate. The presence of air bubbles reduces the attaching strength. Accordingly, the quantity of air bubbles should be reduced as possible in order to assure the attaching. On the other hand, in the case of a glass substrate having a large surface area, if the glass substrate is simply pressed to the film 38, the quantity of air bubbles increases because both the glass substrate and the film have a high flatness. Accordingly, the film 38 is pressed to the glass substrate G by the aid of the press roller 312 to attach them while air bubbles existing between the film 38 and the glass substrate G are discharged outside forcibly. Thus, the glass substrate G can certainly and strongly be attached to the film 38 even in the case of glass substrate G of large surface area. In this embodiment, the attaching is carried out by moving the frame 14 and the glass substrate G with respect to the press roller 312. However, the attaching may be carried out by moving the press roller 312 with respect to the frame 14 and the glass substrate G. Further, the press roller is preferably made of a flexible material without causing the damage of the film 38, such as plastic, rubber, urethane or the like. It goes without saying that the pressing force of the press roller 312 is determined so as not to damage the glass substrate G.

Figure 16:
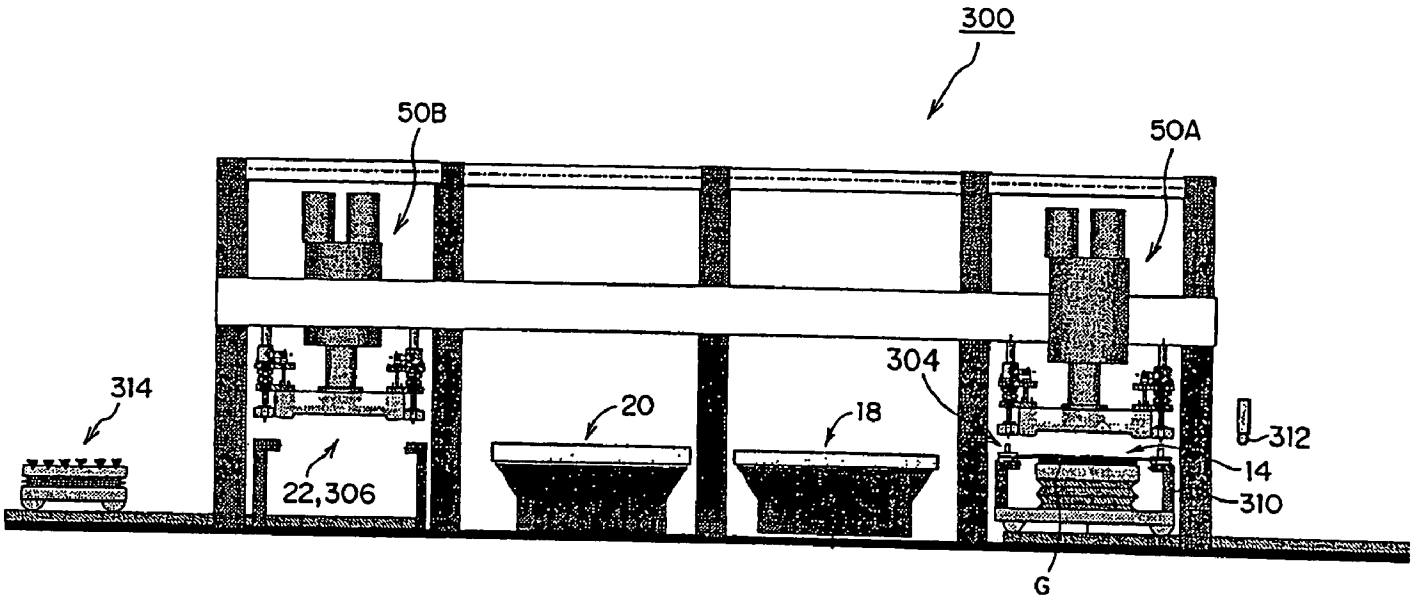
FIG. 16 is a diagram showing an operation of the polishing device shown in FIG. 11.
Figure 17:
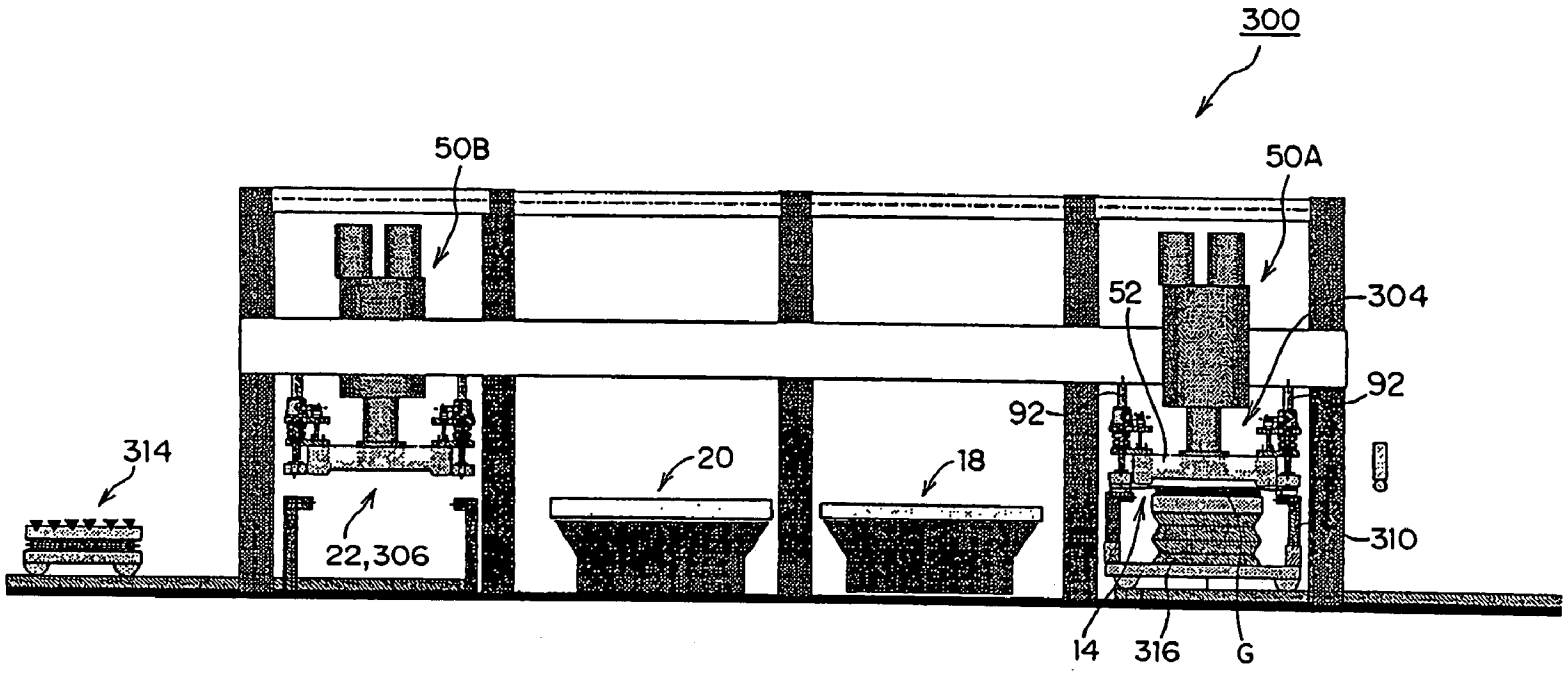
FIG. 17 is a diagram showing an operation of the polishing device shown in FIG. 11.

The frame 14 with the film 38 attached with the glass substrate G is conveyed by the plate attaching shuttle 310 to the position just below the frame installing stage 304 as shown in FIG. 16. Then, the elevating device 316 of the plate attaching shuttle 310 is driven to raise the frame 14 toward the carrier 52 of the polishing head 50A so that the frame 14 is installed on the carrier 52. Then, the screw jacks 92 are operated to lift the frame 14 so that the film 38 has a predetermined tensile force. Thus, the installation of the frame 14 on the carrier 52 of the polishing head 50A is completed.

Figure 18:
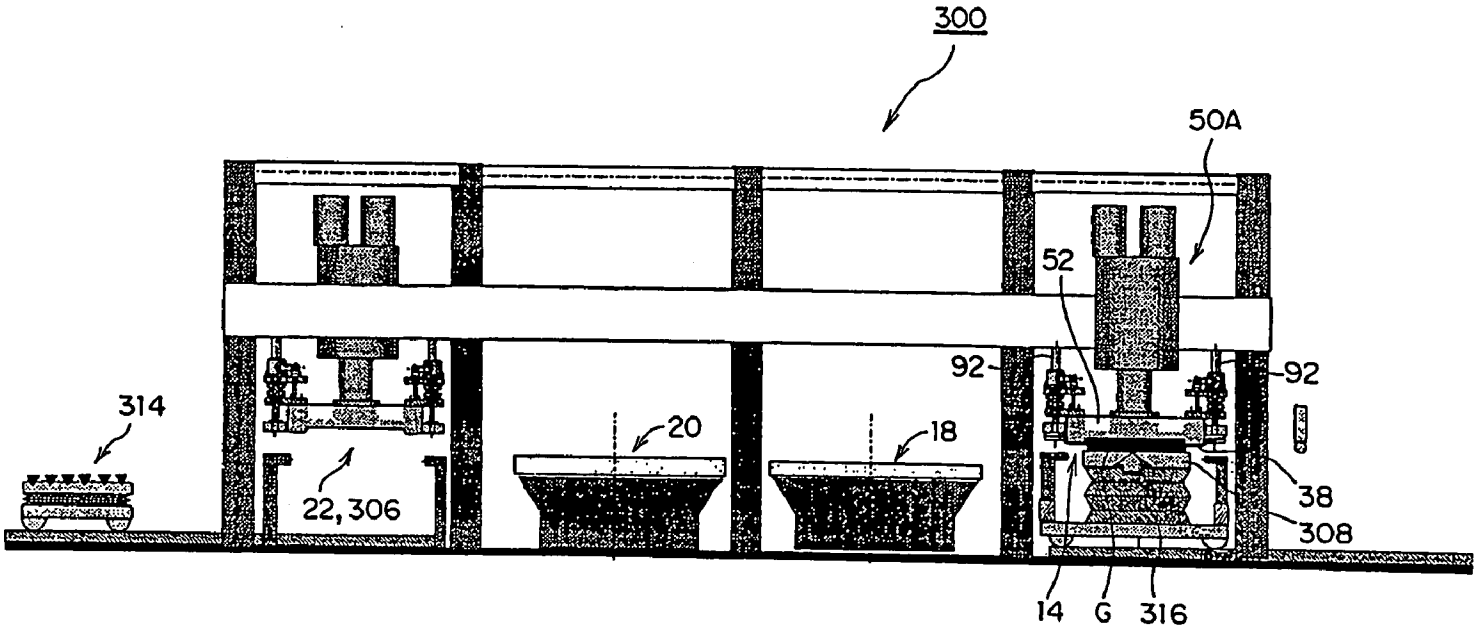
FIG. 18 is a diagram showing an operation of the polishing device shown in FIG. 11.

Here, when the film 38 is stretched by the operations of the screw jacks 92, a local portion of the film 38 may deviate with respect to the glass substrate G to reduce the attaching strength. In order to avoid such disadvantage, the table 308 is raised slightly by the elevating device 316 so that the glass substrate G is pressed to the film 38 by the table 308 as shown in FIG. 18. Thus, the secondly attaching of the glass substrate G to the film 38 prevents the frame 14 from dropping from the polishing head 50A when the frame 14 is conveyed by the polishing head 50A.

The film 38 may be attached to the glass substrate G in the glass substrate attaching stage 16 after the frame 14 is installed on the polishing head 50A in the frame installing stage 304.

Figure 19:
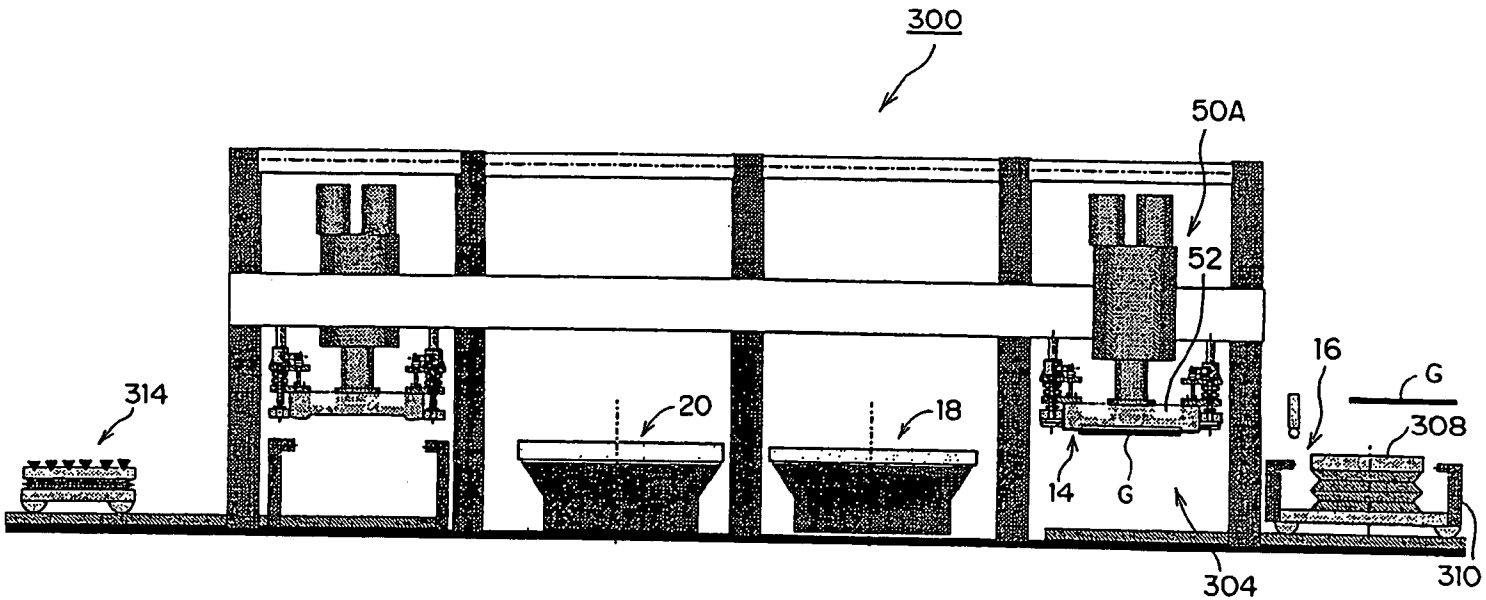
FIG. 19 is a diagram showing an operation of the polishing device shown in FIG. 11.

When the installation of the frame 14 is finished in the frame installation stage 304, the plate attaching shuttle 310 is returned to the glass substrate attaching stage 16 as shown in FIG. 19, and the shuttle is remained on standby at this position until another glass substrate G is placed on the table 308.

Figure 20:
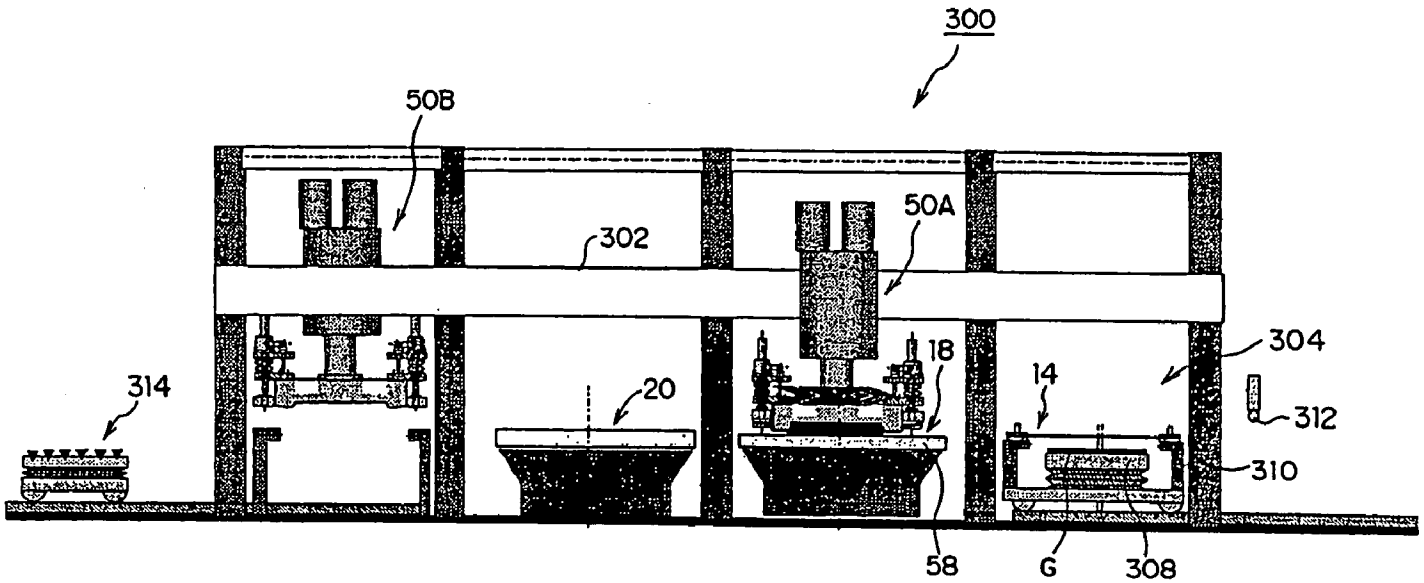
FIG. 20 is a diagram showing an operation of the polishing device shown in FIG. 11.
Figure 21:
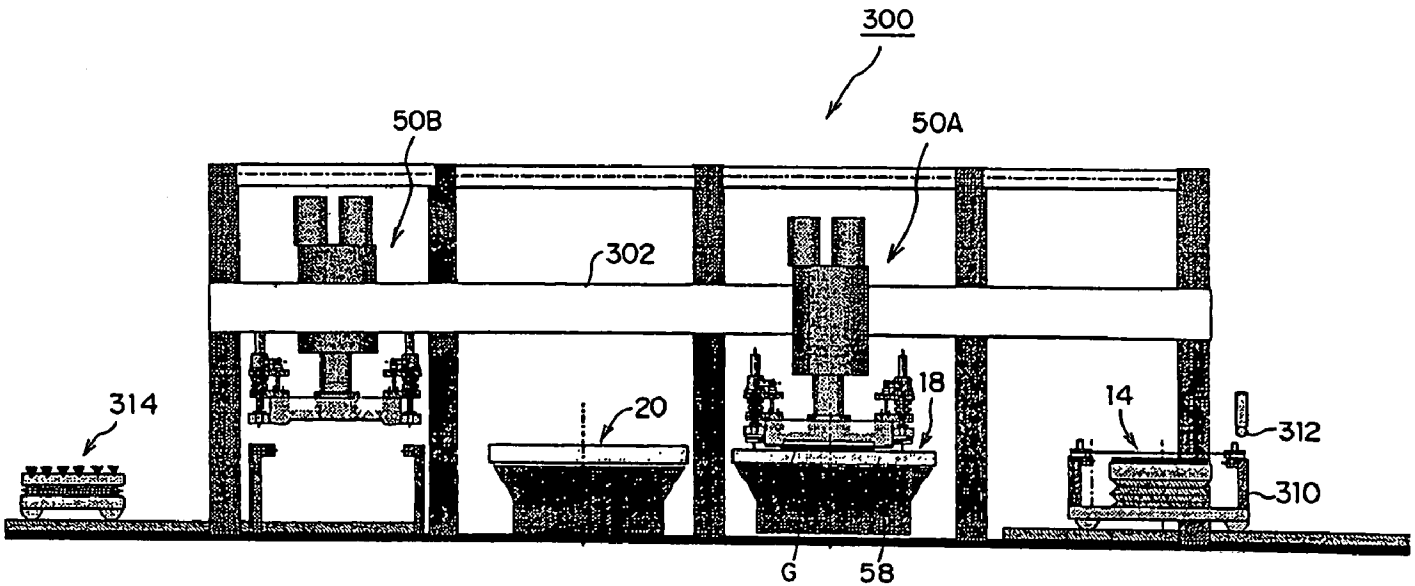
FIG. 21 is a diagram showing an operation of the polishing device shown in FIG. 11.
Figure 22:
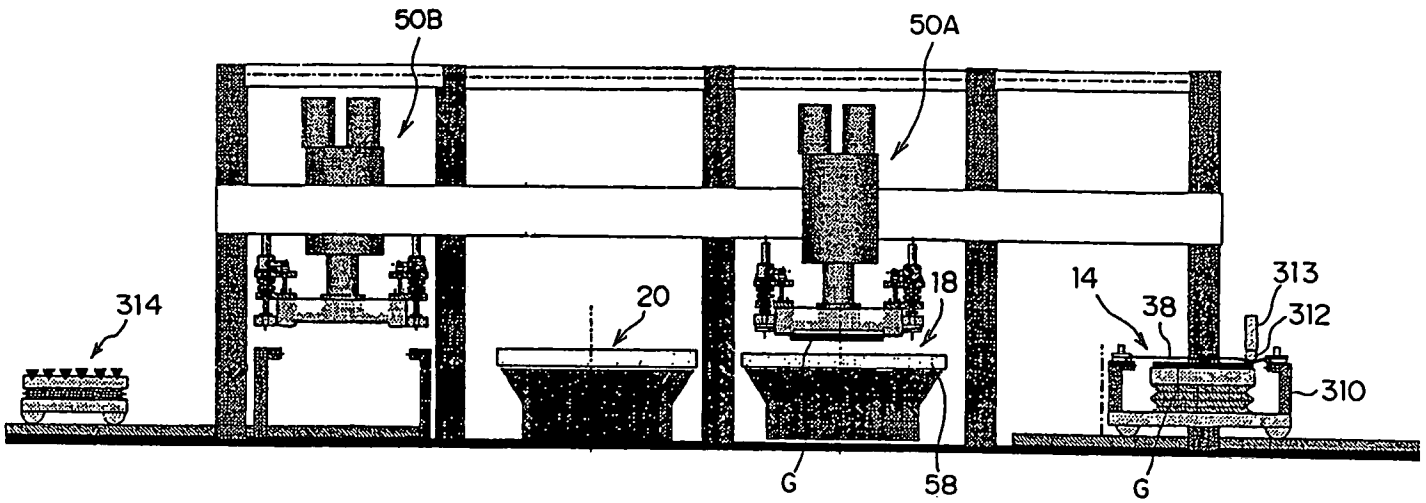
FIG. 22 is a diagram showing an operation of the polishing device shown in FIG. 11.
Figure 23:
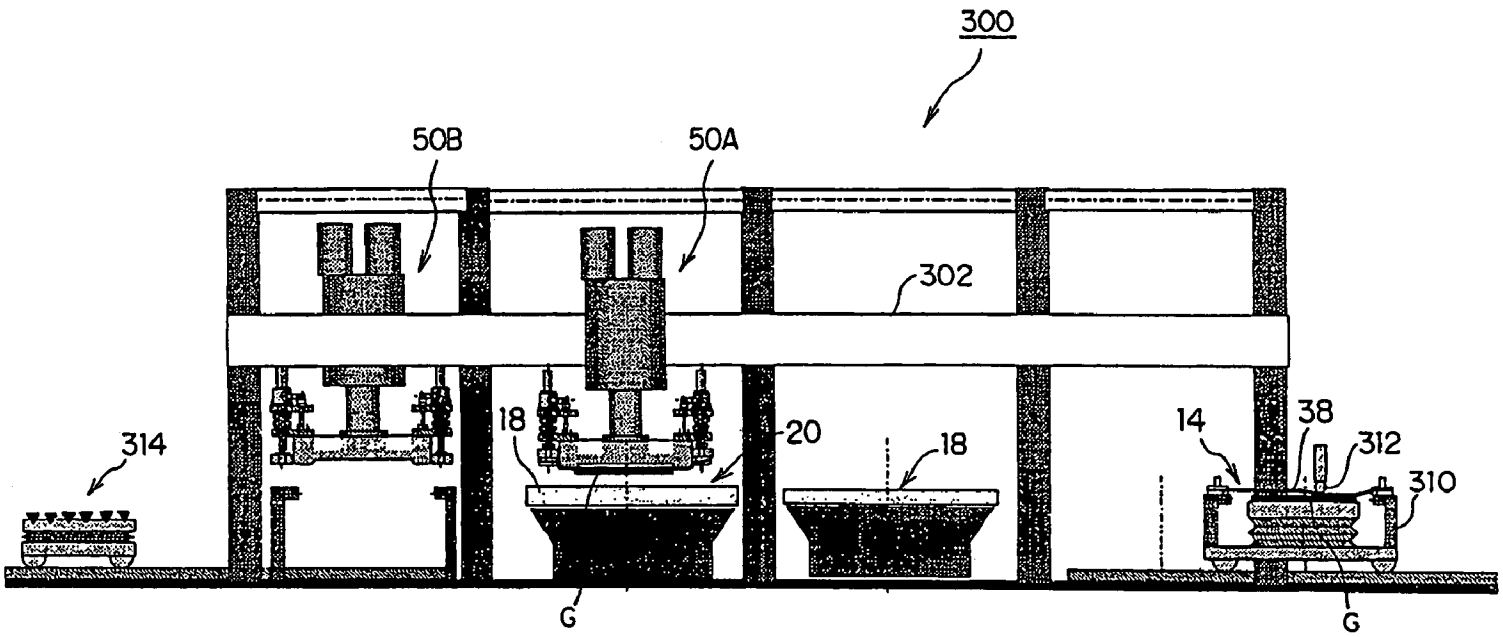
FIG. 23 is a diagram showing an operation of the polishing device shown in FIG. 11.
Figure 24:
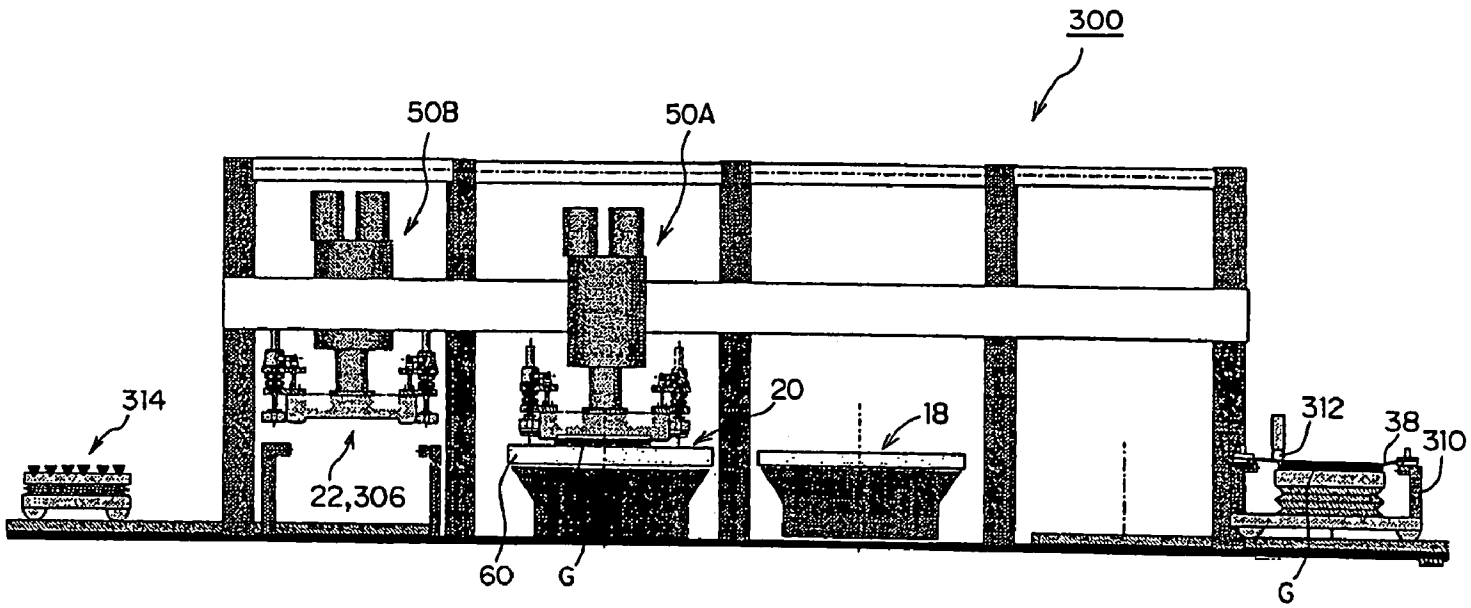
FIG. 24 is a diagram showing an operation of the polishing device shown in FIG. 11.
Figure 25:
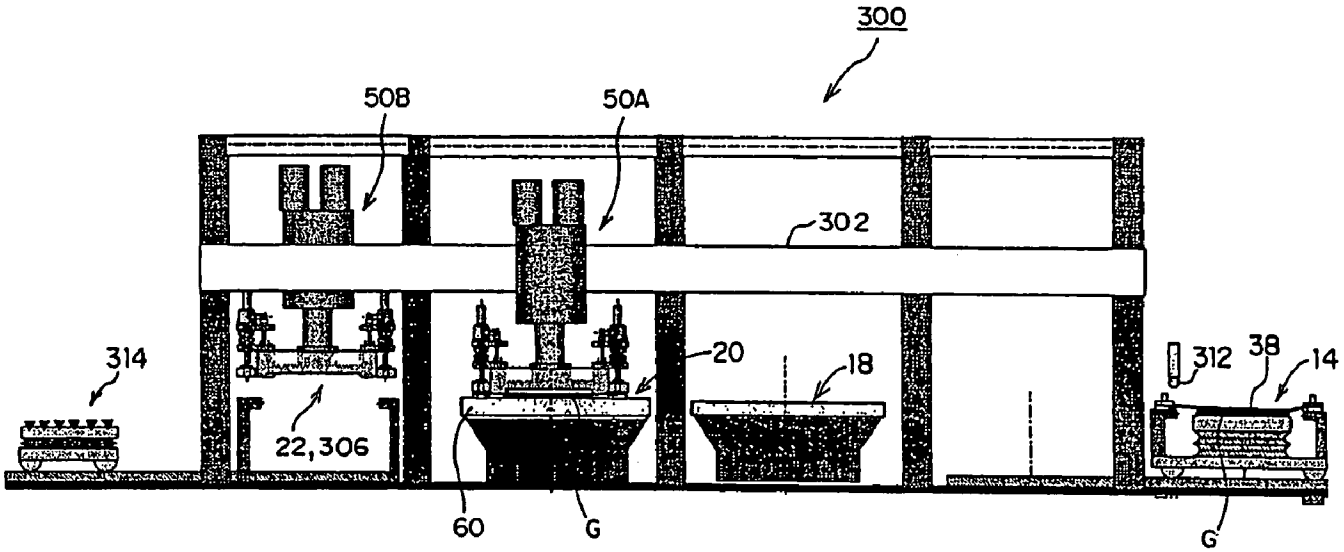
FIG. 25 is a diagram showing an operation of the polishing device shown in FIG. 11.

On the other hand, the polishing head 50A on which the frame 14 is installed is moved along the rail 302 to the first polishing stage 18, and the first glass substrate G attached to the frame 14 is pressed to the polishing pad 58 of the first polishing stage 18 and is subjected to rough polishing, as shown in FIG. 20. During the rough polishing, the second glass substrate G is placed on the table 308 of the plate attaching shuttle 310 and the glass substrate is conveyed by the plate attaching shuttle 310 to the frame installation stage 304 as shown in FIG. 20. Then, a frame 14 is placed on the plate attaching shuttle 310.

When the second frame 14 is placed on the plate attaching shuttle 310, the film 38 of the first frame 14 is conveyed from the rough polishing process in the first polishing stage 18 as shown in FIGS. 21 to 25 to the second polishing stage 20. In the meantime, the film is pressed to a second glass substrate G by means of the press roller 312 to perform the attaching. Explanation of the attaching process by the press roller 312 is omitted because it is the same as that shown in FIGS. 13 to 15. The second glass substrate G in a standby state in that it is attached completely to the film 38. When the rough polishing is finished in the first polishing stage 18, the polishing head 50A is moved along the rail 302 to the second polishing stage 20.

Figure 26:
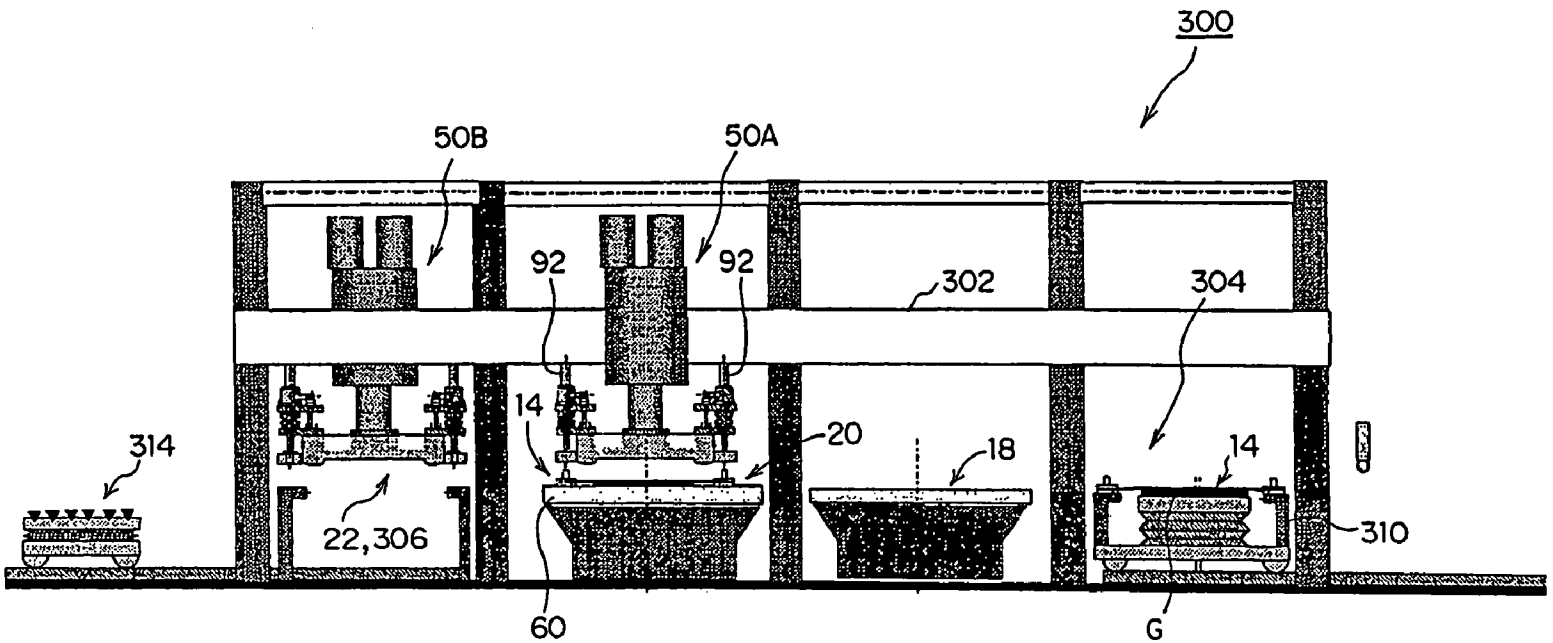
FIG. 26 is a diagram showing an operation of the polishing device shown in FIG. 11.
Figure 27:
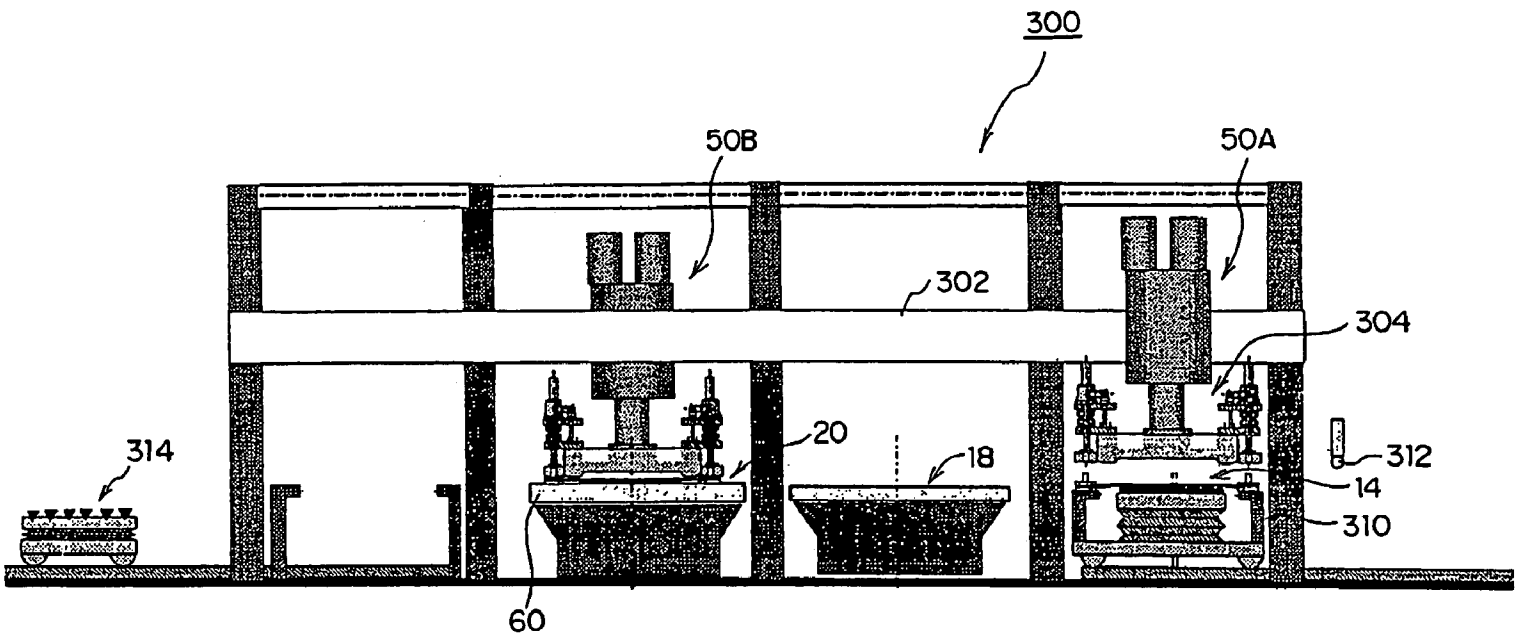
FIG. 27 is a diagram showing an operation of the polishing device shown in FIG. 11.

After the movement to the second polishing stage 20, the screw jacks 92 of the polishing head 50A are relaxed in the state that the glass substrate G is placed on the polishing pad 60, and the frame 14 is removed from the polishing head 50A. Then, the polishing head 50A is raised in the state that the frame 14 is placed on the polishing pad 60 as shown in FIG. 26. During this time, the second glass substrate G is attached to the frame 14 and is in a standby state in the frame installing stage 304.

Figure 28:
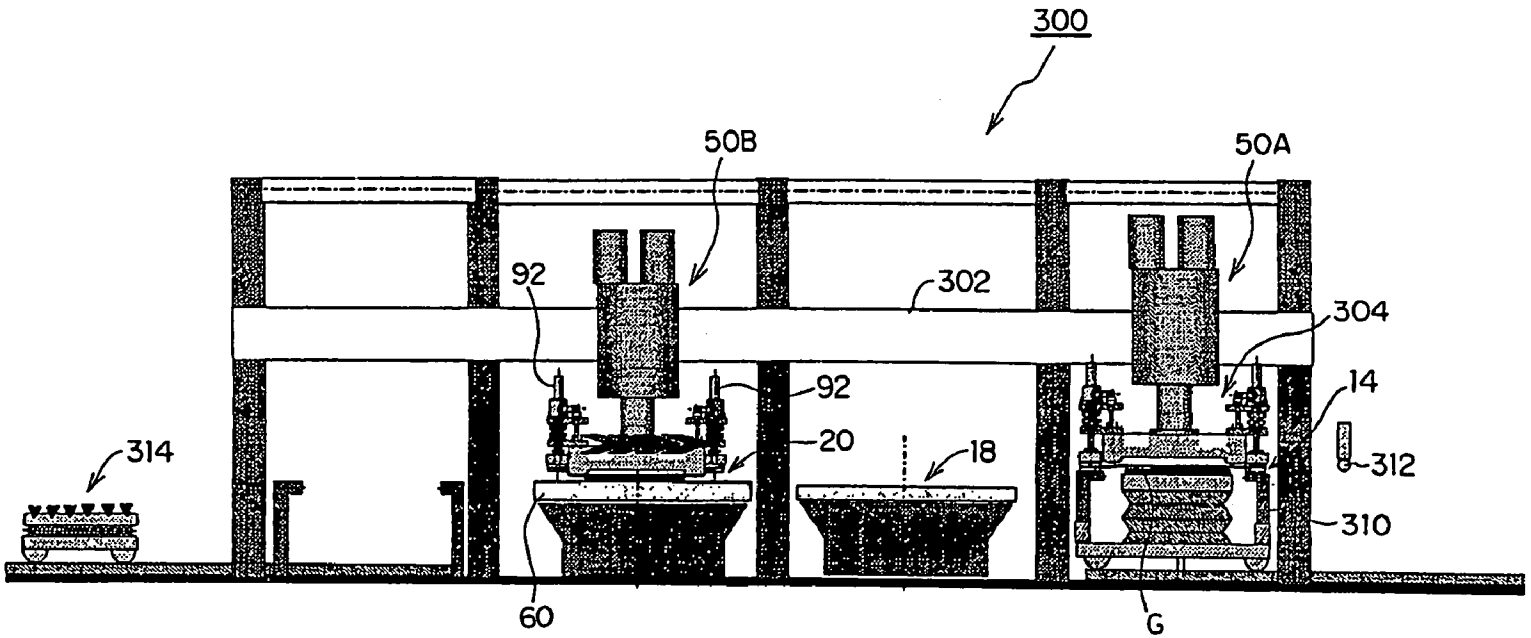
FIG. 28 is a diagram showing an operation of the polishing device shown in FIG. 11.

Then, the polishing head 50A is moved to the frame installing stage 304, and the polishing head 50B which is in a standby state in the substrate removing stage 22 (frame removing stage 306) is moved to the second polishing stage 20 in which the frame 14 on the polishing pad 60 is installed on the polishing head 50B. In this case, the position of the film 38 with respect to the glass substrate G may deviate to cause a reduction of the attaching force since tensile force is again imparted to the relaxed film 38 by the screw jacks 92. To avoid this, compressed air (see FIG. 5) is supplied to the space between the carrier 50 of the polishing head 50B and the film 38 after the film is stretched by the screw jacks 92, so that the film 38 can be pressed to the glass substrate G as shown in FIG. 28. Accordingly, the secondary attaching of the film to the glass substrate G is performed whereby the dropping of the glass substrate from the polishing head 50B can be prevented. Then, the glass substrate G is subjected to fine polishing by the polishing pad 60 of the second polishing stage 20 in the state that the glass substrate is attached to the side of the polishing head 50B. On the other hand, another frame 14 is attached to the polishing head 50A.

Figure 29:
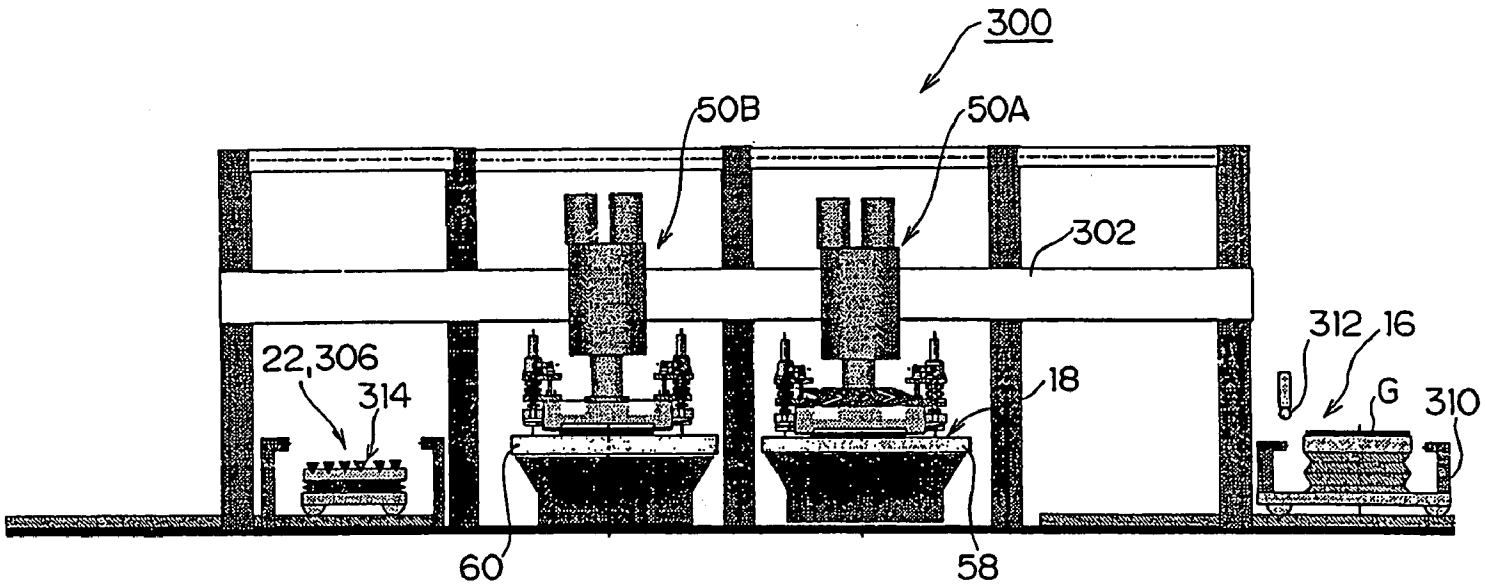
FIG. 29 is a diagram showing an operation of the polishing device shown in FIG. 11.
Figure 30:
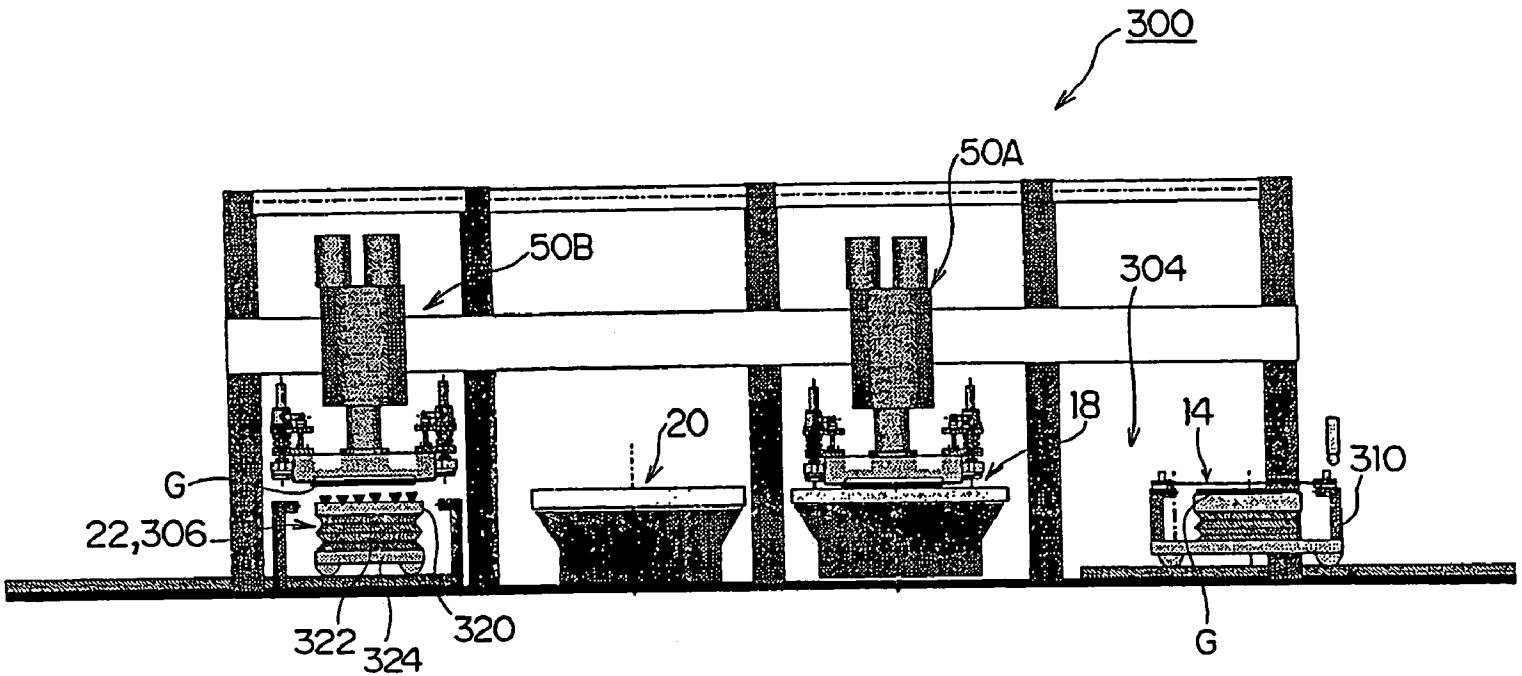
FIG. 30 is a diagram showing an operation of the polishing device shown in FIG. 11.

When the next frame 14 is attached to the polishing head 50A, the polishing head 50A is moved to the first polishing stage 18 and the second glass substrate G is subjected to rough polishing in the stage 18 as shown in FIG. 29. During the rough polishing, the plate separating shuttle 314 is moved to the substrate removing stage 22 (frame removing stage 306) to be in a standby state. Then, the polishing head 50B is moved to the substrate removing stage 22 (frame removing stage 306) as shown in FIG. 30. The plate separating shuttle 314 has a table 320 for the glass substrate G and the table 320 is provided on the shuttle main body 324 by interposing an elevating device 322.

Figure 31:
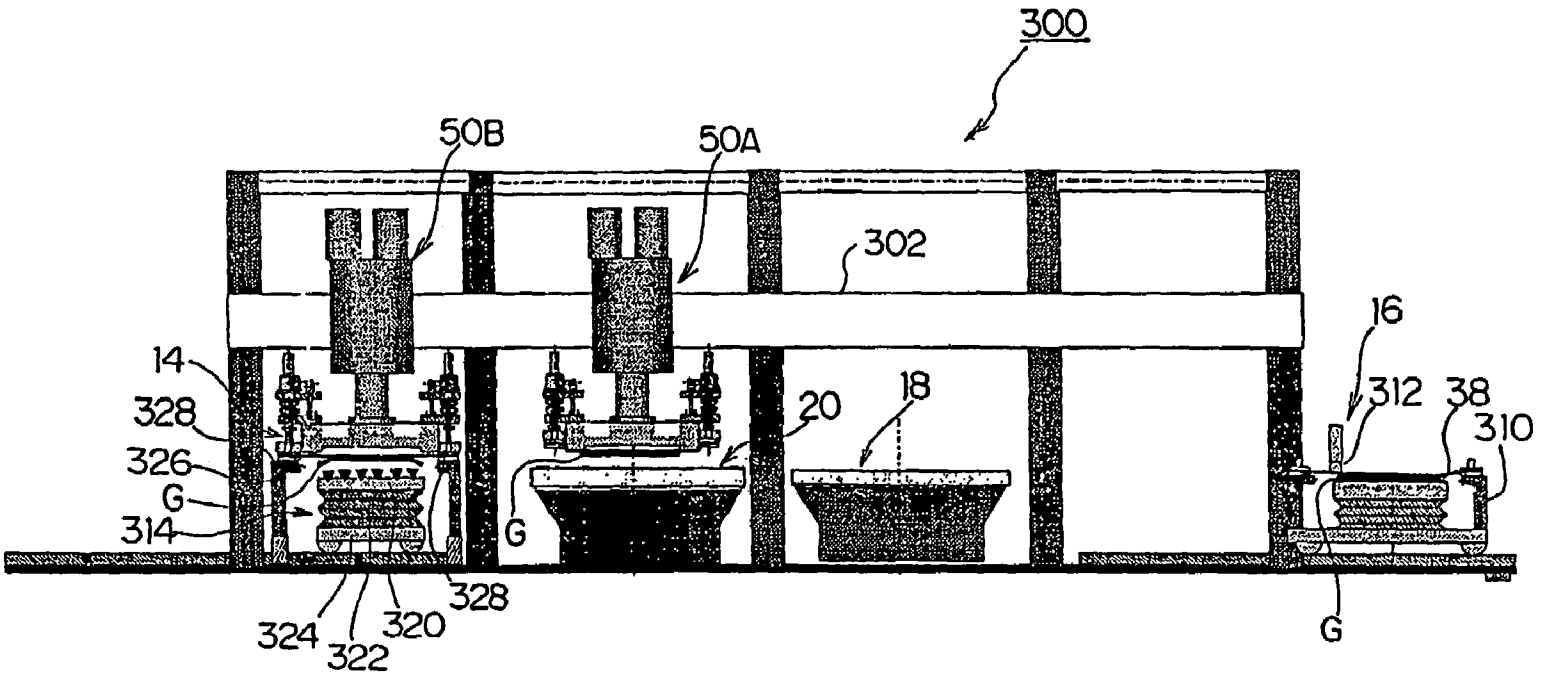
FIG. 31 is a diagram showing an operation of the polishing device shown in FIG. 11.

When the plate separating shuttle 314 is moved to the substrate removing stage 22 (frame removing stage 306), the screw jacks 92 of the polishing head 50B are relaxed so that the frame 14 is removed from the polishing head 50B and is placed on the upper edge portion 328 of a conveying table 326 as shown in FIG. 31.

Figure 32:
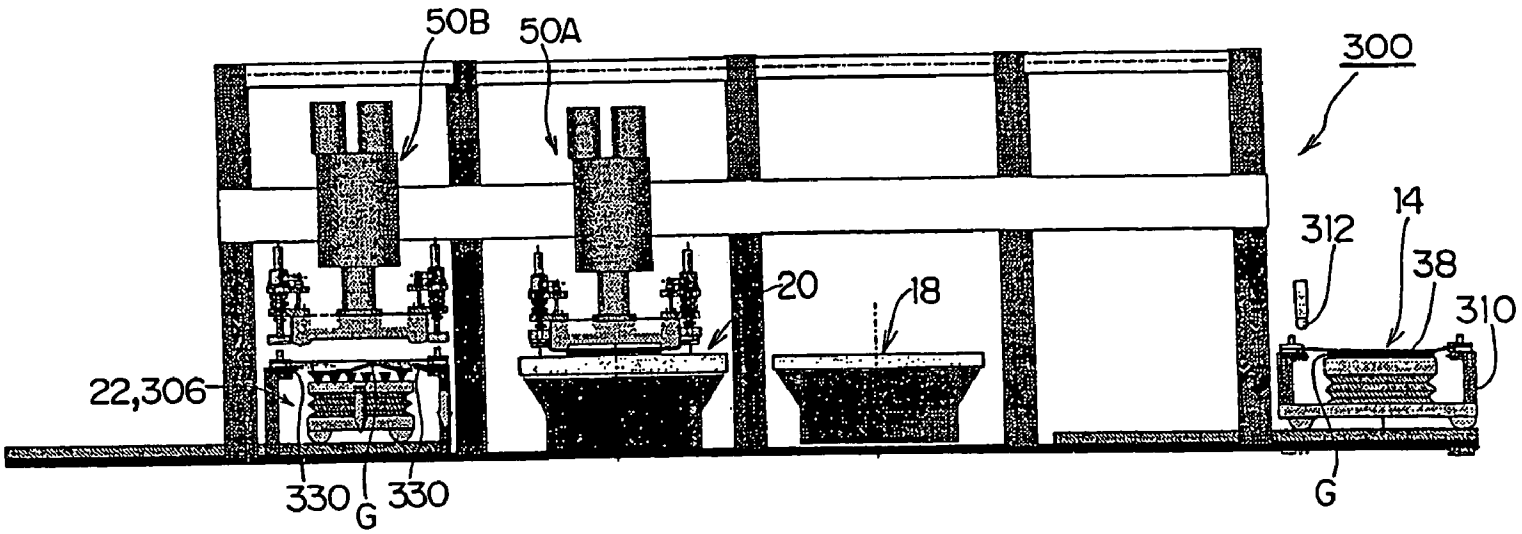
FIG. 32 is a diagram showing an operation of the polishing device shown in FIG. 11.
Figure 33:
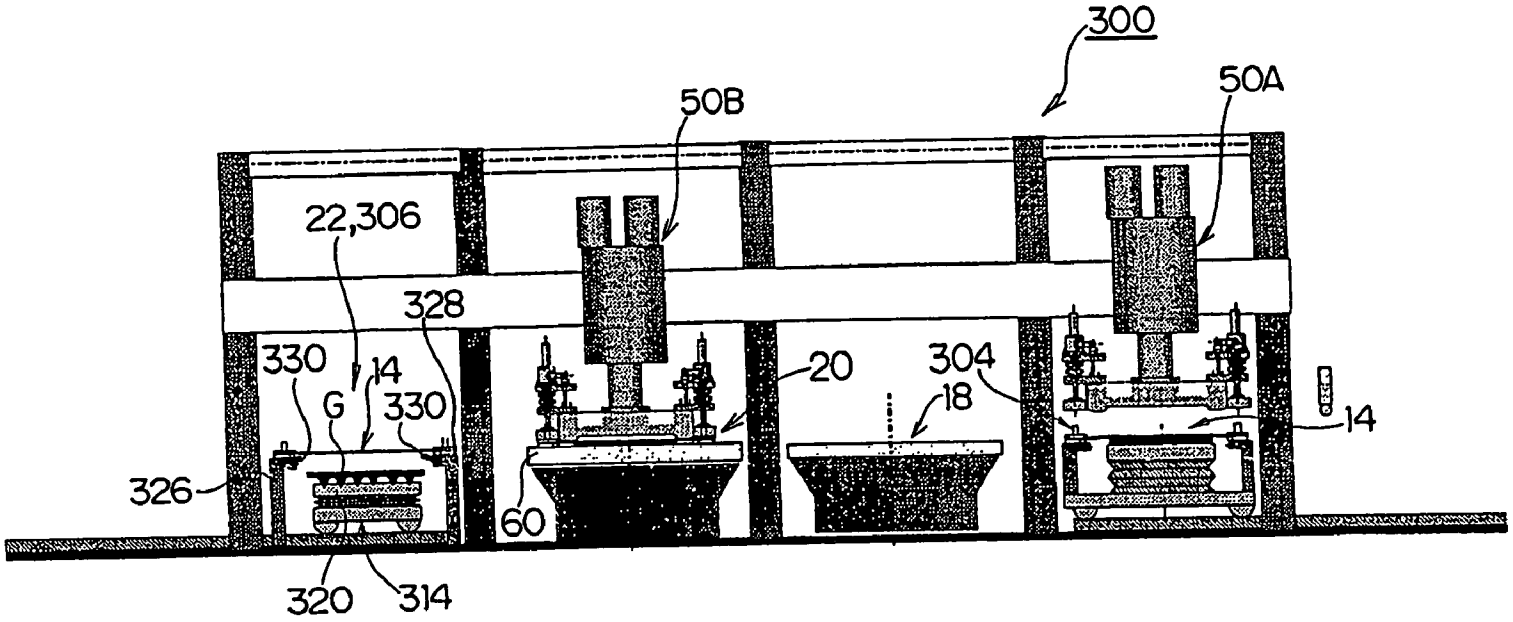
FIG. 33 is a diagram showing an operation of the polishing device shown in FIG. 11.

Then, air (water: fluid) is injected from a plurality of air jet nozzles (which may be water jet nozzles: a supply means for supplying fluid for separation) provided on the conveying table 326 to the boundary between edge portions of the glass substrate G and the film 38 to separate the glass substrate G by utilizing the energy of the injected fluid as shown in FIG. 32. The separated glass substrate G is placed on the table 320 of the plate separating shuttle 314 as shown in FIG. 33. During the separating operation of the glass substrate G, the second glass substrate G is conveyed to the second polishing stage 20 by means of the polishing head 50A. The frame 14 is removed from the polishing head 50A, and the polishing head 50A is moved to the frame installing stage 304. Then, the polishing head 50B is moved to the second polishing stage 20. Then, the glass substrate G is subjected to fine polishing by the polishing pad 60 of the second polishing stage 20 in the state that it is attached to the side of the polishing head 50B.

Figure 34:
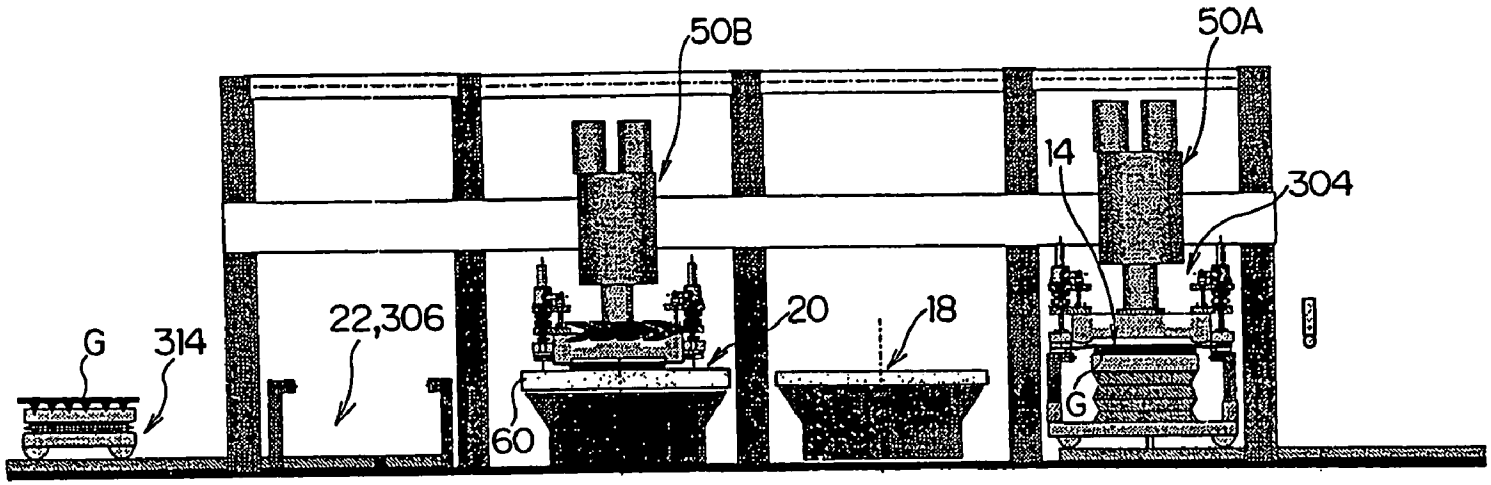
FIG. 34 is a diagram showing an operation of the polishing device shown in FIG. 11.

Instead of separating forcibly the glass substrate G from the film 38 by utilizing the fluid in the substrate removing stage 22 (frame removing stage 306), the glass substrate G can be separated from the film 38 by its own weight, without using fluid. Then, the separated glass substrate G is placed on the carriage 320 of the plate separating shuttle 314 and is conveyed from the substrate removing stage 22 (frame removing stage 306) to a product storage space as shown in FIG. 34. By repeating the above-mentioned series of operations, glass substrates G can continuously be polished with good efficiency.

Further, the frame 14 may be removed from the polishing head 50B after the glass substrate G is separated from the film 38 in the substrate removing stage 22 (frame removing stage 306).

Figure 35:
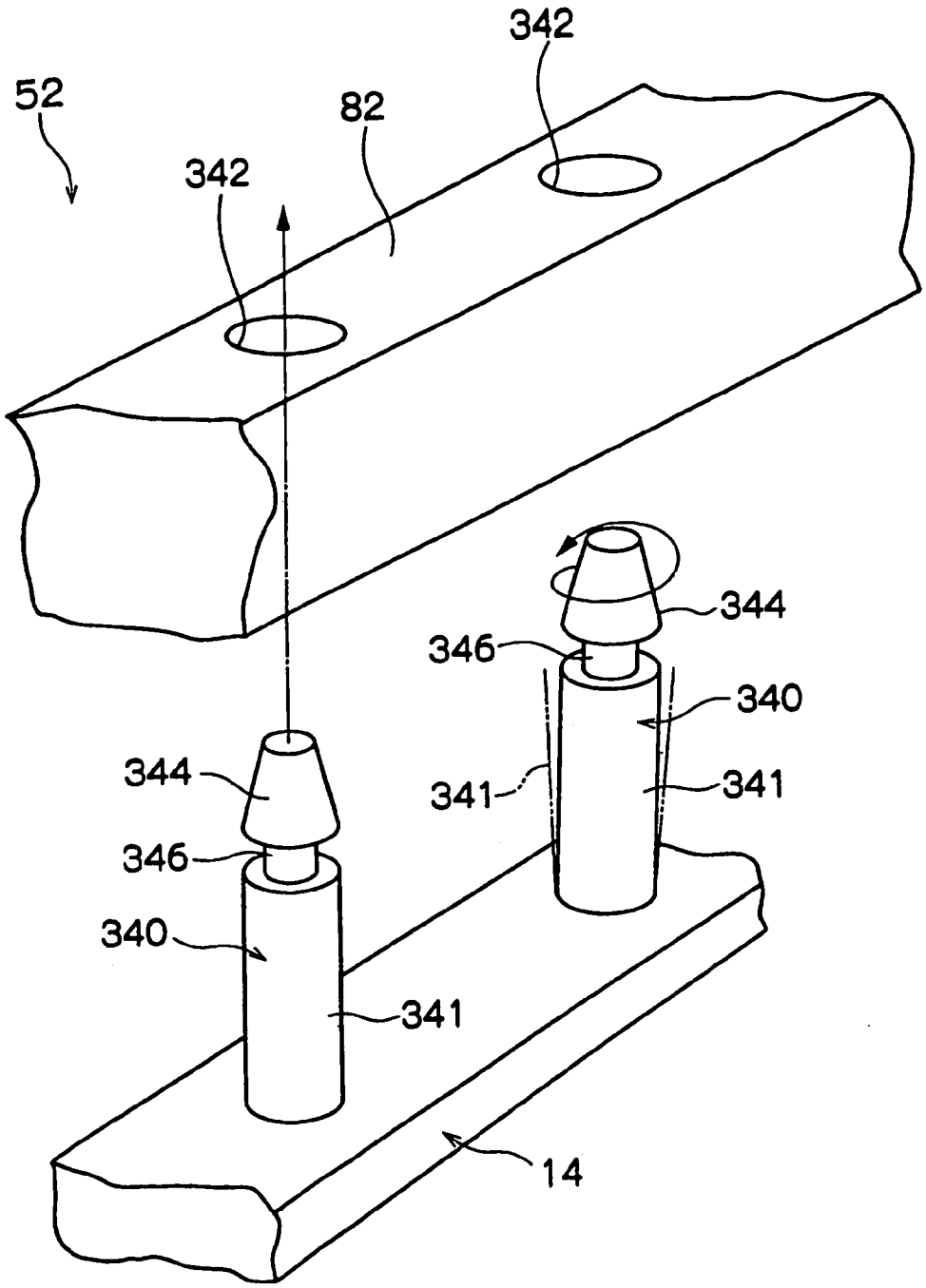
FIG. 35 is a perspective view of an important portion showing a position determining structure for a frame to a carrier.
Figure 36A:
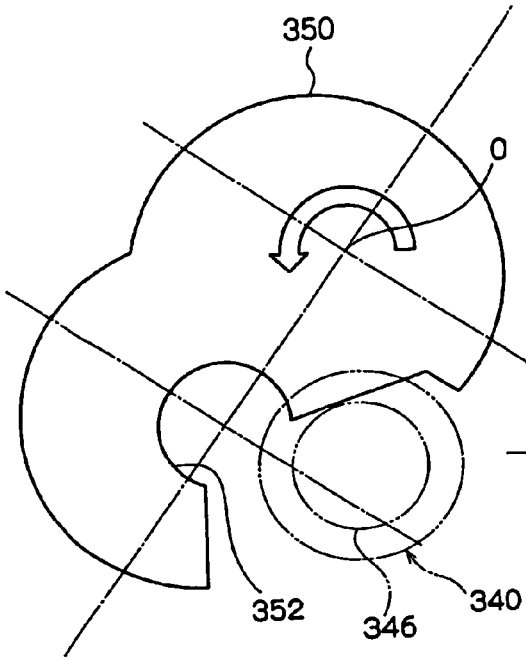
FIG. 36 is a plan view of a hook to be engaged with a pin in the position determining structure shown in FIG. 35.
Figure 36B:
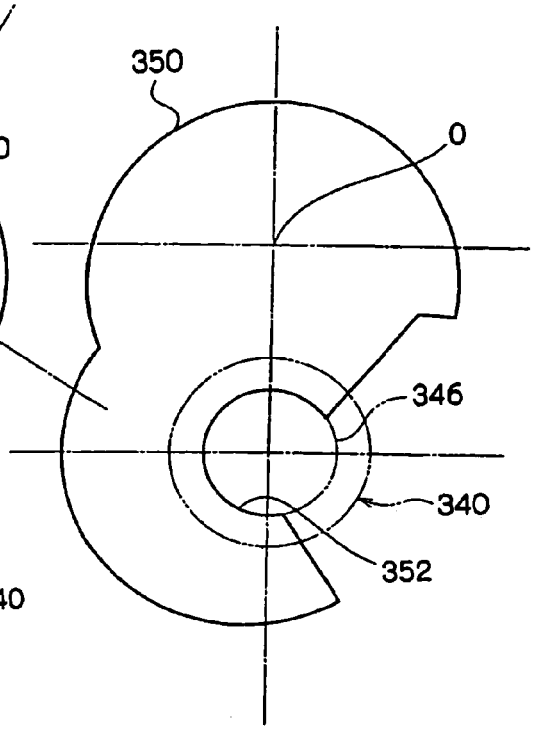

FIGS. 35 and 36 are diagrams showing the structure for determining the position of the frame 14 with respect to the slide-contact ring 82 of the carrier 52. In FIG. 35, a plurality of pins 340, 340 . . . (only two pins are shown in FIG. 35) are provided on the frame 14 and openings 342, 342 . . . to be fitted with these pins 340, 340 . . . are formed in the slide-contact ring 82. By fitting the pins 340, 340 . . . to the openings 342, 342 . . . , the position of the frame 14 with respect to the slide-contact ring 82 is determined.

A predetermined number of pins 340 among the plurality of pins 340, 340 . . . are attached to the frame 14 so as to be swung as shown in FIG. 35, and the remaining pins 340 are fixed firmly to the frame 14 in order to determine the position of the frame with respect to the carrier.

The attachment of the pins 340 to the frame 14 so as to be swung is effective for the polishing device for polishing, in particular, a glass substrate G having a large surface area. In the case of connecting the frame 14 to the slide-contact ring 82 (i.e., the carrier 52) for determining mutual positions by fitting the plurality of pins 340, 340 . . . provided on the frame 14 to the plurality of openings 342, 342 . . . formed in the slide-contact ring 82, if the frame is a small-sized frame, the pins 340 can be attached with high precision. Accordingly, all the pins 340, 340 . . . can be fitted to the openings without any difficulty even though the all pins 340, 340 . . . are attached fixedly to the frame.

On the other hand, in the case of using a large-sized frame 14 for attaching a glass substrate G having a large surface area, it is difficult to attach the pins 340 with higher precision. Accordingly, if all the pins 340, 340 . . . are attached fixedly to the frame 14, it is difficult to fit all the pins 340, 340 . . . into the openings 342, 342 . . . . On the other hand, if all the pins 340, 340 . . . are attached to the frame 14 so as to be swung, the fitting of the pins 340, 340 . . . can be easy because error in the attachment can be absorbed by the swinging movement of the pins. In this case, however, if the all the pins 340, 340 . . . are provided so as to be swung, the position of the frame 14 becomes unstable because there is a possibility of shift of the frame 14 with respect to the carrier 52. Further, there is a possibility that the pins 340 can not withstand the shearing force applied by the polishing pad 58 (60) at the time of polishing.

Accordingly, in the embodiment as shown in FIG. 35, a predetermined number of pins 340 among the plurality of pins 340, 340 . . . are attached to the frame 14 so as to be swung so that error in the attachment can be absorbed by these swing pins 340. The remaining pins (e.g., two pins) 340, 340 are attached fixedly to the frame 14 so that these pins 340, 340 . . . can withstand the shearing force applied from the polishing pad 58 (60). Accordingly, the large-sized frame 14 can be positioned precisely to the carrier 52 and a steady connection can be assured.

Further, each pin 340 has a tapered portion at its tip portion 344 so as to make the fitting of the pin 340 to the opening 342 easy, and further, a thin portion 346 is formed at the boundary between the tip portion 344 and a cylindrical main body portion 341. The thin portion 346 projects from the opening 342 when the pin 340 is fitted to the opening 342. Further, the thin portion is fitted to a circular-arc-like fitting portion 352 of a hook 350 shown in FIG. 36. This hook 350 is attached to the carrier 52 so as to be rotatable around a fixed support O. When the hook is rotated in a counterclockwise direction from the state shown in FIG. 36 (A), the hook is fitted to the thin portion 346 of the pin 340. Thus, the frame 14 can be held on the carrier 52 by engaging the pin 340 with the hook 350.

Figure 37:
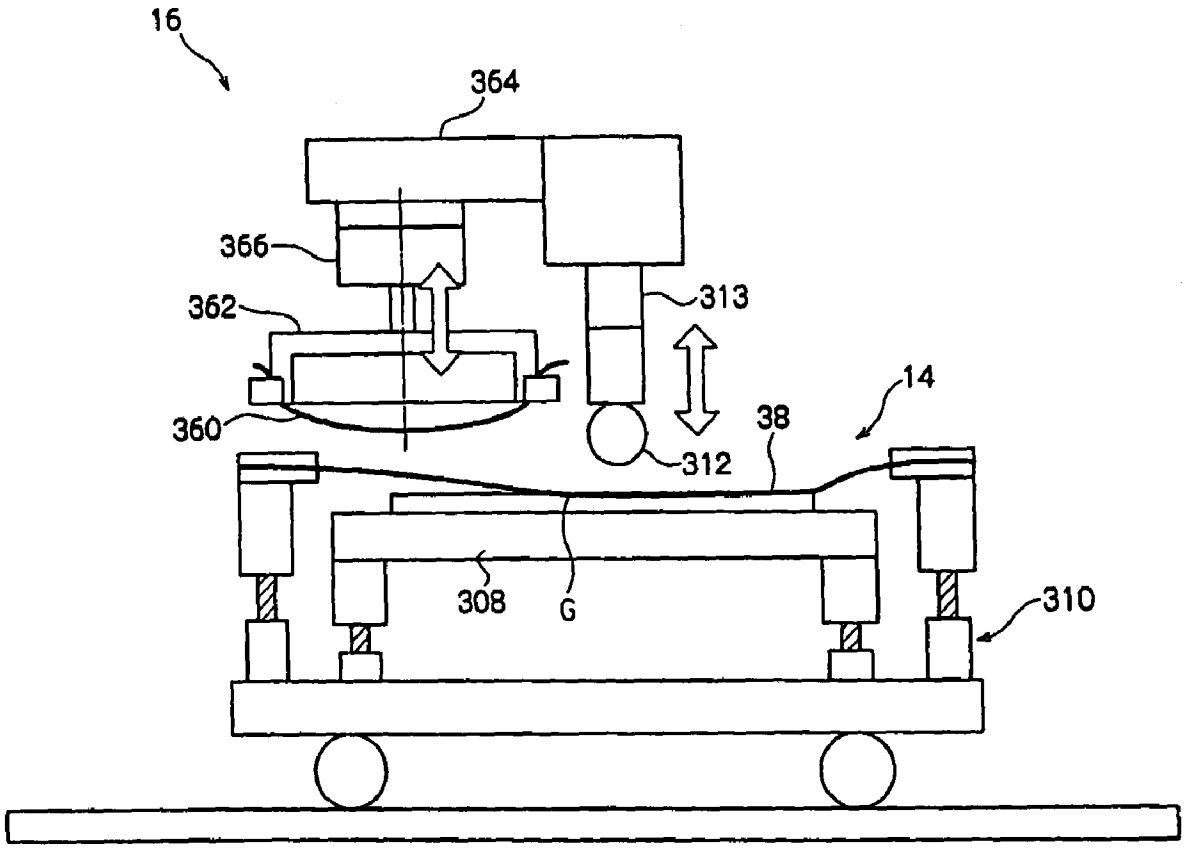
FIG. 37 is a side view showing the structure of a press roller with a balloon.

FIG. 37 is a diagram showing another embodiment of the glass substrate attaching stage 16 shown in FIG. 11, in which a film pressing balloon 360 is provided in addition to the press roller 312.

The film pressing balloon 360 is made of rubber and is formed to have a circular shape. The balloon is disposed to close the opening at a lower portion of a head 362. The balloon 360 is inflated by supplying compressed air from an air supply source (not shown) into the space between the head 362 and the film pressing balloon.

The head 362 is attached to a support frame 364 for supporting the press roller 312 via a cylinder unit 366 so as to be ascended and descended, namely, the head is advanced and retracted with respect to the frame 14 disposed above the glass substrate G.

An example of the attaching method using the film pressing balloon 360 will be described. First, before the attaching by using the press roller 312, the film pressing balloon 360 inflated is pressed to the central portion of the film 38 to contact closely the central portion of the film 38 to the glass substrate G. Then, the film pressing balloon 360 is retracted upward from the frame 14, and then, the attaching by the press roller 312 is initiated. Thus, it is possible to carry out the stable attaching without air bubbles between the film 38 and the glass substrate G.

INDUSTRIAL APPLICABILITY

As described above, in the method and device for polishing a substrate according to the present invention, a substrate is attached to a frame which can be attached to or detached from a carrier, and after the completion of the polishing in a polishing stage, the polished substrate is removed from the frame in a substrate removing stage which is remote from the polishing stage. Accordingly, it is possible to solve the problems of the reduction of productivity due to the stopping of the polishing machine when a large-sized substrate is removed and discharged. Therefore, productivity can be improved remarkably. Namely, when a substrate is polished, another substrate can be attached to a frame or another substrate having been subjected to polishing can be removed. Accordingly, stable working can be assured and a large-sized substrate can safely be polished with stable quality.

Further, in the present invention, the frame from which a substrate is removed is washed in a washing stage and then, the frame can be used for attaching another substrate. Accordingly, it is enough to prepare a necessary minimum number of frames, and therefore, it serves resource saving.

In addition, in the present invention, pressurized fluid is supplied from a supply means for supplying pressurized fluid for polishing between the carrier and the film of a frame so that the substrate is pressed for polishing to a polishing surface-plate by the pressure of the pressurized fluid.

Accordingly, each portion of the substrate is applied with uniform pressure and therefore, the substrate can be polished flat.

Further, the film of the present invention has a three-layered structure comprising an air-tightness retention layer having its outer peripheral portion in contact hermetically with the carrier to thereby maintain air-tightness with respect to the carrier, a strength retention layer holding the air-tightness retention layer and having a predetermined tensile strength durable to a tensile force for stretching the film and a smooth layer to which the substrate is attached. Accordingly, the substrate can stably be held by the film and the substrate can be polished with high precision.

In addition, the strength retention layer of the film is made of alamide fibers, a mesh of stainless steel, a mesh of steel, carbon fibers, glass fibers, nylon fibers or a material having the same tensile strength as these materials. Accordingly, it is possible to guarantee the strength of the film when the substrate is pressed to the polishing surface-plate with a pressing force suitable for polishing.

Further, in the present invention, the substrate can be separated from the frame by a separating function which is obtained by supplying fluid from a supply means for supplying fluid for separation to the boundary between the film of the frame and edge portions of the substrate. Accordingly, the substrate can be separated from the frame in a shorter time to thereby improve productivity.

Further, in the present invention, the substrate is placed on a table in a substrate attaching stage, and then, the film of a frame is put on the substrate placed on the table, and then, a press roller is pressed to the film on the substrate while the table and the press roller are moved relatively along the surface of the film by a moving means whereby the substrate is attached to the film by the press roller. Accordingly, the substrate can certainly and firmly attached to the film even when the substrate has a large surface area.

Further, in the present invention, the frame and the carrier are attached to or detached from each other by means of a plurality of pins wherein a predetermined number of pins among the plurality of pins are attached to the frame so as to be swung, and the remaining pins are attached fixedly to the frame so as to serve the determination of the position with respect to the carrier. Accordingly, the position of a large-sized frame to the carrier can be correct and they can stably be connected.

The entire disclosure of Japanese Patent Application No. 2002-223001 filed on Jul. 31, 2002 including specification, claims, drawings and summary is incorporated herein by reference in its entirety.

What is claimed is:

1. A method for polishing a substrate comprising:

attaching a substrate to a film on a frame;

bringing the frame and a polishing surface-plate closer relative to each other and polishing a surface of the substrate attached to the film by pressing the surface of the substrate to the polishing surface-plate; and removing the substrate from the film on the frame after completing the polishing of the surface of the substrate, wherein the substrate is removed from the frame by supplying fluid to the boundary between the film on the frame and an edge portion of the substrate.

2. A device for polishing a substrate comprising:

a substrate attaching stage configured to attach a substrate to a frame by attachment to a film on the frame;

a polishing stage configured to polish the substrate by bringing the frame and a polishing surface-plate closer relative to each other and pressing a surface to be polished of the substrate attached to the film attached to the frame to the polishing surface-plate; and a substrate removing stage configured to remove the polished substrate from the film on the frame, wherein the substrate removing stage is provided with a supply means for supplying fluid to the boundary between the film on the frame and an edge portion of the substrate to remove the substrate from the frame.

3. A method for polishing a substrate comprising:

attaching a substrate to a film on a frame, wherein the step of attaching the substrate to the film on the frame comprises, placing the substrate on a table, placing the film attached to the frame on the substrate placed on the table, and pressing a press roller to the film placed on the substrate while the table and the press roller are moved relatively along the surface of the film, whereby the substrate is attached to the film by the press roller;

bringing the frame with the attached film having the attached substrate and a polishing surface-plate closer relative to each other and polishing a surface of the substrate by pressing the surface of the substrate to the polishing surface-plate; and removing the substrate from the film attached to the frame after completing the polishing of the surface of the substrate.

4. A device for polishing a substrate comprising:

a substrate attaching stage configured to attach a substrate to a frame by attachment to a film on the frame, wherein the substrate attaching stage comprises, a table on which the substrate is placed and covered by the film attached to the frame, a press roller, and a moving means for moving the table carrying the substrate covered by the film attached to the frame and the press roller relative to each other so that the press roller is pressed to the film covering the substrate while the table and the press roller are moved relative to each other along the surface of the film, whereby the film attached to the frame is attached to the substrate by the press roller;

a polishing stage configured to polish the substrate by bringing the frame and a polishing surface-plate closer relative to each other and pressing a surface to be polished of the substrate attached to the film attached to the frame to the polishing surface-plate; and a substrate removing stage configured to remove the polished substrate from the film on the frame.

5. A device for polishing a substrate comprising:

a substrate attaching stage configured to attach a substrate to a frame by attachment to a film on the frame;

a frame installing stage configured to detachably connect the frame to a carrier via a plurality of pins, wherein a predetermined number of pins among the plurality of pins are fitted to be swung to the frame, and the remaining pins are fixed thereto so as to be used for determining the position to the carrier;

a polishing stage configured to polish the substrate by bringing the frame connected to the carrier and a polishing surface-plate closer relative to each other and pressing a surface to be polished of the substrate attached to the film attached to the frame connected to the carrier to the polishing surface-plate; and a substrate removing stage configured to remove the polished substrate from the film on the frame.

* * * * *